US007930173B2

(12) United States Patent
Fujii

(10) Patent No.: US 7,930,173 B2
(45) Date of Patent: Apr. 19, 2011

(54) SIGNAL PROCESSING METHOD, SIGNAL PROCESSING APPARATUS AND RECORDING MEDIUM

(75) Inventor: Osamu Fujii, Yaita (JP)

(73) Assignee: Sharp Kabushiki Kaisha, Osaka (JP)

( * ) Notice: Subject to any disclaimer, the term of this patent is extended or adjusted under 35 U.S.C. 154(b) by 930 days.

(21) Appl. No.: 11/812,381

(22) Filed: Jun. 18, 2007

(65) Prior Publication Data

US 2007/0293960 A1 Dec. 20, 2007

(30) Foreign Application Priority Data

Jun. 19, 2006 (JP) ..... 2006-169263
Jun. 19, 2006 (JP) ..... 2006-169264

(51) Int. Cl.
*G10L 19/00* (2006.01)

(52) U.S. Cl. ..... 704/222

(58) Field of Classification Search ..... 704/220–230
See application file for complete search history.

(56) References Cited

U.S. PATENT DOCUMENTS

| | | | | |
|---|---|---|---|---|
| 5,150,387 | A * | 9/1992 | Yoshikawa et al. | 375/240 |
| 5,630,011 | A | 5/1997 | Lim et al. | |
| 7,031,912 | B2 * | 4/2006 | Yajima et al. | 704/208 |
| 2006/0004583 | A1 | 1/2006 | Herre et al. | |

FOREIGN PATENT DOCUMENTS

| | | | |
|---|---|---|---|
| EP | 1 199 812 | A1 | 4/2002 |
| EP | 1 351 218 | A2 | 10/2003 |
| FR | 2 849 727 | A1 | 7/2004 |
| JP | 07-005899 | | 1/1995 |
| JP | 8-162964 | A | 6/1996 |
| JP | 10-285031 | | 10/1998 |
| JP | 2000-224045 | A | 8/2000 |
| JP | 2002-328698 | A | 11/2002 |
| JP | 2002-351500 | A | 12/2002 |
| JP | 2003-99099 | A | 4/2003 |
| JP | 2003-108197 | A | 4/2003 |
| JP | 2003-208197 | A | 7/2003 |
| JP | 2003-223193 | A | 8/2003 |
| JP | 2003-323198 | A | 11/2003 |
| JP | 2004-134900 | A | 4/2004 |
| JP | 2005-26940 | A | 1/2005 |
| JP | 2005-195983 | A | 7/2005 |
| WO | WO-00/45379 | A2 | 8/2000 |

* cited by examiner

*Primary Examiner* — Abul Azad
(74) *Attorney, Agent, or Firm* — Birch, Stewart, Kolasch & Birch, LLP

(57) ABSTRACT

Provided is a signal processing method which can enhance the resolution of a spectrum round off by quantization and compensate energy of a spectrum truncated to zero by quantization so as to achieve reproduction without dissatisfaction or uncomfortable feeling. The selecting circuit selects a plurality of coefficients from coefficients of a frequency band of a dequantized acoustic signal. The computing circuit then computes an interpolation coefficient of a coefficient, which is not selected by the selecting circuit, by an interpolation method such as a Lagrange's interpolation method or a spline interpolation method which uses the plurality of coefficients selected by the selecting circuit.

8 Claims, 27 Drawing Sheets

FIG. 16

| | Fs=32kHz | Fs=44.1kHz | Fs=48kHz |
|---|---|---|---|
| 1 | 32kbps | 32kbps | 32kbps |
| 2 | 64kbps | 48kbps | 40kbps |
| 3 | 96kbps | 56kbps | 48kbps |
| 4 | 128kbps | 64kbps | 56kbps |
| 5 | 160kbps | 80kbps | 64kbps |
| 6 | 192kbps | 96kbps | 80kbps |
| 7 | 224kbps | 112kbps | 96kbps |
| 8 | 256kbps | 128kbps | 112kbps |
| 9 | 288kbps | 160kbps | 128kbps |
| 10 | 320kbps | 192kbps | 160kbps |
| 11 | 352kbps | 224kbps | 192kbps |
| 12 | 384kbps | 256kbps | 224kbps |
| 13 | 416kbps | 320kbps | 256kbps |
| 14 | 448kbps | 384kbps | 320kbps |

FIG. 20

| | | MDCT COEFFICIENT M(m) | | | | | | | | |
|---|---|---|---|---|---|---|---|---|---|---|
| | | M(1) | M(2) | M(3) | M(4) | M(5) | M(6) | M(7) | M(8) | |
| FRAME | Fr001 | −0.035606 | 0.441635 | 0.022963 | −0.406259 | −0.005408 | 0.035493 | 0.003289 | −0.012311 | ··· |
| | Fr002 | −0.087749 | 0.045265 | −1.270477 | −0.031818 | −0.083181 | 0.006561 | 0.019770 | −0.003374 | ··· |
| | Fr003 | 0.026968 | −0.437179 | −0.148029 | 0.403126 | −0.002780 | −0.034847 | −0.001342 | 0.011978 | ··· |
| | Fr004 | 0.090403 | −0.088301 | 1.255906 | 0.071500 | 0.082908 | −0.009992 | −0.019902 | 0.004553 | ··· |
| | Fr005 | −0.018070 | 0.428488 | 0.271658 | −0.396088 | 0.010941 | 0.033865 | −0.000615 | −0.011529 | ··· |
| | Fr006 | −0.092182 | 0.130482 | −1.229164 | −0.110492 | −0.081831 | 0.013325 | 0.019841 | −0.005688 | ··· |
| | Fr007 | 0.008995 | −0.415643 | −0.392656 | 0.385211 | −0.018998 | −0.032553 | 0.002570 | 0.010969 | ··· |
| | Fr008 | 0.093067 | −0.171397 | 1.190510 | 0.148411 | 0.079962 | −0.016529 | −0.019588 | 0.006767 | ··· |
| | Fr009 | 0.000167 | 0.398771 | 0.509850 | −0.370603 | 0.026868 | 0.030925 | −0.004499 | −0.010303 | ··· |
| | Fr010 | −0.093051 | 0.210652 | −1.140321 | −0.184893 | −0.077316 | 0.019573 | 0.019146 | −0.007783 | ··· |
| | Fr011 | −0.009326 | −0.378034 | −0.622102 | 0.352401 | −0.034478 | −0.028998 | 0.006383 | 0.009538 | ··· |
| | Fr012 | 0.092132 | −0.247865 | 1.079083 | 0.219583 | 0.073922 | −0.022429 | −0.018518 | 0.008722 | ··· |
| | Fr013 | 0.018395 | 0.353635 | 0.728327 | −0.330786 | 0.041755 | 0.026790 | −0.008205 | −0.008678 | ··· |
| | Fr014 | −0.090322 | 0.282677 | −1.007386 | −0.252146 | −0.069812 | 0.025065 | 0.017710 | −0.009575 | ··· |
| | Fr015 | −0.027286 | −0.325807 | −0.827493 | 0.305964 | −0.048628 | −0.024322 | 0.009949 | 0.007738 | ··· |
| | Fr016 | 0.087636 | −0.314749 | 0.925928 | 0.282265 | 0.065025 | −0.027460 | −0.016730 | 0.010337 | ··· |
| | ⋮ | ⋮ | ⋮ | ⋮ | ⋮ | ⋮ | ⋮ | ⋮ | ⋮ | |

ABSOLUTE VALUE
OF MDCT COEFFICIENT
-95Hz-

SIGNAL PROCESSING METHOD, SIGNAL PROCESSING APPARATUS AND RECORDING MEDIUM

CROSS-REFERENCE TO RELATED APPLICATIONS

This nonprovisional application claims priority under 35 U.S.C. 119(a) on Patent Application No. 2006-169263 in Japan on Jun. 19, 2006 and Patent Application No. 2006-169264 in Japan on Jun. 19, 2006, the entire contents of which are hereby incorporated by reference.

BACKGROUND OF THE INVENTION

1. Field of the Invention

The present invention relates to a signal processing method and a signal processing apparatus for processing an acoustic signal obtained by dequantizing a coded acoustic signal and a computer-readable recording medium for causing the signal processing apparatus to function as a computer.

2. Description of the Prior Art

Known as a technique for coding an acoustic signal is MP3 (MPEG 1 Audio Layer 3), AAC (Advanced Audio Coding), ATRAC (Adaptive TRansform Acoustic Coding), WMA (Windows (registered trademark) Media Audio), AC-3 (Audio Code Number 3) and the like. In the MP3 method, for example, an acoustic signal is divided into a plurality of frequency bands and blocked in a unit of varying-length time in order to achieve high efficient compression. The blocked digital data is transformed into a spectrum signal by the MDCT (Modified Discrete Cosine Transform) process and each spectrum 5 signal is further coded by bits which are allocated using the auditory psychology characteristic (see Patent Documents 1 to 3, for example).

An acoustic signal coded as described above is decoded by a decoding apparatus. FIG. 1 is a block diagram showing the lo hardware structure of a conventional decoding apparatus. Denoted at 100 in the figure is a conventional decoding apparatus which comprises an unpacking circuit 101, a dequantizing circuit 102, a frequency-time transforming circuit 103, a frequency band synthesizing circuit 104 and an acoustic signal output unit 105. A 15 coded acoustic signal is inputted into the unpacking circuit 101, and the quantization coefficient, the scale factor, the scale factor multiplexer, the global gain and the subblock gain are respectively unpacked from frame information of the acoustic signal. The coded acoustic signal is then dequantized into an IMDCT (Inverse 20 Modified Discrete Cosine Transform) coefficient by the dequantizing circuit 102 using the quantization coefficient, the scale factor, the scale factor multiplexer, the global gain and the subblock gain.

The IMDCT coefficient obtained by dequantization by the dequantizing circuit 102 undergoes an IMDCT process at the 25 frequency-time transforming circuit 103 for each frequency band and transformed into data in relation to time axis. The inverted frequency band further undergoes band synthesis by an IPFB (Inverse Polyphase Filter Bank), which is a band synthesizing filter, at the frequency band synthesizing circuit 104 and then outputted to the acoustic signal output unit 105 (see Patent Document 3, for example).

Moreover, a technique has been disclosed for complementing a spectrum at the time of decoding with a spectrum for power adjustment in order to compensate for the lack of sense of power caused by compression (see Patent Document 4, for example). In the technique described in Patent Document 4, power adjustment information to be used for complement is generated at a power adjustment information deciding circuit in a coding apparatus based on the characteristic of an input audio signal at the time of coding. Next, the power adjustment information is coded together with the coded audio signal. The coded power adjustment information is then decoded at a power adjustment information decoding circuit in a decoding apparatus and power adjustment information is further generated at a power correction spectrum generating and synthesizing circuit so as to complement the decoded audio signal with the power adjustment information. Moreover, a decoding apparatus for generating, at the time of decoding, expanded frequency spectrum information indicative of the harmonic structure equal to one obtained by expanding the harmonic structure indicated by low frequency spectrum information on the frequency axis to a frequency band which is not expressed by a coded string is also known (see Patent Document 5, for example).

[Patent Document 1]
Japanese Patent Application Laid-Open No. 2002-351500
[Patent Document 2]
Japanese Patent Application Laid-Open No. 2005-195983
[Patent Document 3]
Japanese Patent Application Laid-Open No. 2005-26940
[Patent Document 4]
Japanese Patent Application Laid-Open No. 2003-323198
[Patent Document 5]
Japanese Patent Application Laid-Open No. 2003-108197

However, in the technique wherein an acoustic signal is quantized in the process of coding, there is a problem that rounding or round-down by quantization may cause energy loss of the acoustic signal. Therefore, the user may feel dissatisfaction at the acoustic signal due to the energy loss even at the time of decoding. Moreover, as the technique described in Patent Document 4 is designed to complement power, it is necessary to analyze an input audio signal by a coding apparatus at the time of coding and generate power adjustment information so as to code the signal. Furthermore, it is also necessary to provide a power adjustment information decoding circuit in a decoding apparatus and decode the coded power adjustment information, and there is a problem that interpolation of energy cannot be performed at all for an acoustic signal for which such power adjustment information is not stored. Especially, since coding methods associated with various specifications are made indiscriminately in recent years, there is a problem that the technique described in Patent Document 4 cannot suitably interpolate a coded acoustic signal of various methods. Moreover, as the decoding apparatus described in Patent Document 5 newly generates spectrum information for a frequency band for which a coded string is not expressed, only spectrum information of a low frequency zone is expanded to a high frequency zone and the technique is still not good enough to sufficiently complement dissatisfaction or uncomfortable feeling to an acoustic signal due to an quantization error.

BRIEF SUMMARY OF THE INVENTION

The present invention has been made with the aim of solving the above problems. An object of the present invention is to provide: a signal processing method and a signal processing apparatus for selecting a plurality of coefficients from coefficients of a frequency band of a dequantized acoustic signal and computing an interpolation coefficient of a coefficient, which is not selected, by an interpolation method which uses the plurality of selected coefficients, so as to suitably interpolate energy lost in quantization and deal with various coding methods in decoding; and a computer-readable recording medium for causing a computer to function as the signal processing apparatus.

Another object of the present invention is to provide a signal processing apparatus for detecting a quantization bit rate at a time of quantization and computing an interpolation coefficient by an interpolation method for a coefficient the detected quantization bit rate of which is equal to or smaller than a predetermined value, so as to execute an interpolation process only for a coefficient having a larger quantization error.

Another object of the present invention is to provide a signal processing apparatus for deciding an effective range, where a coefficient may exist, to be decided based on a quantization bit rate and a scale factor of a coefficient of a frequency band and correcting an interpolation coefficient when the computed interpolation coefficient does not exist in the effective range, so as to prevent occurrence of an error in an interpolation process.

Another object of the present invention is to provide: a signal processing method and a signal processing apparatus for computing an absolute value of a coefficient of a frequency band of a dequantized acoustic signal, computing an interpolation coefficient of a coefficient by an interpolation method which uses the plurality of selected coefficients and adding a sign of a corresponding coefficient to the interpolation coefficient, so as to suitably interpolate energy lost in quantization while enhancing the interpolation accuracy and deal with various coding methods in decoding; and a computer-readable recording medium for causing a computer to function as the signal processing apparatus.

Another object of the present invention is to provide a signal processing apparatus for computing a degree of correlation between a plurality of adjacent coefficients and a sine orthogonal transform coefficient when a coefficient is zero, extracting a sign of an orthogonal transform coefficient corresponding to a plurality of orthogonal transform coefficients having a high degree of correlation and adding the sign, so as to interpolate not only a spectrum lost in quantization but also a sign thereof in accordance with regularity.

Another object of the present invention is to provide a signal processing apparatus for modifying an interpolation coefficient to zero when the computed interpolation coefficient has a negative sign, so as to prevent occurrence of an interpolation error.

Another object of the present invention is to provide: a signal processing method and a signal processing apparatus for computing an interpolation coefficient of a coefficient by an interpolation method which uses the plurality of selected coefficients when it is not determined that the acoustic signal is a pure tone, so as to deal with various coding methods in decoding and suitably interpolate energy; and a program for causing a computer to function as the signal processing apparatus.

Another object of the present invention is to provide a signal processing method and the like for determining whether a bit rate of an acoustic signal is smaller than a prestored reference bit rate or not and computing an interpolation coefficient of a coefficient by an interpolation method which uses the plurality of selected coefficients when it is determined that the bit rate of the acoustic signal is smaller than the reference bit rate, so as to deal with various coding methods in decoding and suitably interpolate energy.

A signal processing method according to the present invention for processing an acoustic signal obtained by dequantizing a coded acoustic signal comprises: a selecting step of selecting a plurality of coefficients from coefficients of a frequency band of a dequantized acoustic signal; and a computing step of computing an interpolation coefficient of a coefficient, which is not selected in the selecting step, by an interpolation method which uses the plurality of coefficients selected in the selecting step.

A signal processing apparatus according to the present invention for processing an acoustic signal obtained by dequantizing a coded acoustic signal comprises: a selecting circuit for selecting a plurality of coefficients from coefficients of a frequency band of a dequantized acoustic signal; and a computing circuit for computing an interpolation coefficient of a coefficient, which is not selected by the selecting circuit, by an interpolation method which uses the plurality of coefficients selected by the selecting circuit.

The selecting circuit of a signal processing apparatus according to the present invention is constructed to select a plurality of coefficients according to a quantization bit rate equal to or larger than the predetermined value detected by the detecting circuit from coefficients of a frequency band of a dequantized acoustic signal.

A signal processing apparatus according to the present invention further comprises a detecting circuit for detecting a quantization bit rate at a time of quantization of a coefficient of a frequency band of a dequantized acoustic signal, wherein the computing circuit is constructed to compute an interpolation coefficient of a coefficient, the quantization bit rate of which detected by the detecting circuit is equal to or smaller than a predetermined value, by an interpolation method which uses the plurality of coefficients selected by the selecting circuit.

A signal processing apparatus according to the present invention further comprises: an effective range deciding circuit for deciding an effective range, where a coefficient may exist, to be decided based on a quantization bit rate and a value relating to a scale factor of a coefficient of a frequency band; and a correcting circuit for correcting an interpolation coefficient when the interpolation coefficient computed by the computing circuit does not exist in the effective range decided by the effective range deciding circuit.

The interpolation method in the computing circuit according to the present invention is a Lagrange's interpolation method or a spline interpolation method.

The selecting circuit according to the present invention is constructed to select at least coefficients at both ends from coefficients of each frequency band of a dequantized acoustic signal.

The selecting circuit according to the present invention is constructed to select coefficients at both ends, a coefficient having a maximum value and a coefficient having a minimum value from coefficients of each frequency band of a dequantized acoustic signal.

A computer-readable recording medium according to the present invention which records therein a program for causing a computer to process an acoustic signal obtained by dequantizing a coded acoustic signal comprises: a selecting step of selecting a plurality of coefficients from coefficients of a frequency band of a dequantized acoustic signal; and a computing step of computing an interpolation coefficient of a coefficient, which is not selected in the selecting step, by an interpolation method which uses the plurality of coefficients selected in the selecting step.

A signal processing method according to the present invention for processing an acoustic signal obtained by dequantizing a coded acoustic signal comprises: an absolute value computing step of computing an absolute value of a coefficient of a frequency band of a dequantized acoustic signal; a selecting step of selecting a plurality of coefficients from coefficients according to the absolute value computed in the absolute value computing step; a computing step of computing an interpolation coefficient of a coefficient, which is not selected in the selecting step, by an interpolation method which uses the plurality of coefficients selected in the selecting step; and an adding step of adding a sign of a corresponding coefficient to the interpolation coefficient computed in the computing step.

A signal processing apparatus according to the present invention for processing an acoustic signal obtained by dequantizing a coded acoustic signal comprises: an absolute value computing circuit for computing an absolute value of a coefficient of a frequency band of a dequantized acoustic signal; a selecting circuit for selecting a plurality of coefficients from coefficients according to the absolute value computed by the absolute value computing circuit; a computing circuit for computing an interpolation coefficient of a coefficient, which is not selected by the selecting circuit, by an interpolation method which uses the plurality of coefficients selected by the selecting circuit; and an adding circuit for adding a sign of a corresponding coefficient to the interpolation coefficient computed by the computing circuit.

A signal processing apparatus according to the present invention further comprises: a correlation degree computing circuit for computing a degree of correlation between a plurality of coefficients adjacent to a coefficient of a frequency band of a dequantized acoustic signal and a plurality of orthogonal transform coefficients read out from a coefficient storage which stores a sine orthogonal transform coefficient when said coefficient is zero; and a sign extracting circuit for extracting a sign of an orthogonal transform coefficient corresponding to a plurality of orthogonal transform coefficients having a high degree of correlation obtained by the correlation degree computing circuit, wherein the adding circuit is constructed to add a sign extracted by the sign extracting circuit to an interpolation coefficient according to the coefficient computed by the computing circuit.

A signal processing apparatus according to the present invention further comprises a modifying circuit for modifying an interpolation coefficient computed by the computing circuit to zero when said interpolation coefficient has a negative sign.

A computer-readable recording medium according to the present invention which records therein a program for causing a computer to process an acoustic signal obtained by dequantizing a coded acoustic signal comprises: an absolute value computing step of computing an absolute value of a coefficient of a frequency band of a dequantized acoustic signal; a selecting step of selecting a plurality of coefficients from coefficients according to the absolute value computed in the absolute value computing step; a computing step of computing an interpolation coefficient of a coefficient, which is not selected in the selecting step, by an interpolation method which uses the plurality of coefficients selected in the selecting step; and an adding step of adding a sign of a corresponding coefficient to the interpolation coefficient computed in the computing step.

In the present invention, the selecting circuit selects a plurality of coefficients from coefficients of a frequency band of a dequantized acoustic signal. The computing circuit then computes an interpolation coefficient of a coefficient, which is not selected by the selecting circuit, by an interpolation method, such as a Lagrange's interpolation method or a spline interpolation method, which uses the plurality of coefficients selected by the selecting circuit. Accordingly, a coefficient, which is not selected, of a frequency band of an acoustic signal is interpolated smoothly, that is, the resolution of a quantized coefficient can be enhanced, and reproduction without dissatisfaction or uncomfortable feeling can be achieved.

In the present invention, the detecting circuit detects a quantization bit rate at a time of quantization of a coefficient of a frequency band of a dequantized acoustic signal. The present invention is constructed to then compute an interpolation coefficient of a coefficient, the quantization bit rate of which detected by the detecting circuit is equal to or smaller than a predetermined value, by an interpolation method which uses a plurality of coefficients selected by the selecting circuit. Accordingly, it is possible to perform an interpolation process in a concentrated manner for a coefficient having a small quantization bit rate and a large quantization error, and it becomes possible to reproduce a more accurate signal.

In the present invention, the selecting circuit selects a plurality of coefficients according to the quantization bit rate detected by the detecting circuit equal to or larger than the predetermined value from coefficients of a frequency band of a dequantized acoustic signal. In this manner, it is possible to make a coefficient having a high quantization bit rate a reference of interpolation and further enhance the accuracy.

In the present invention, the effective range deciding circuit decides an effective range, where a coefficient may exist, to be decided based on a quantization bit rate and a value relating to a scale factor of a coefficient of a frequency band. The correcting circuit then corrects an interpolation coefficient when the interpolation coefficient computed by the computing circuit does not exist in the effective range. Accordingly, it becomes possible to prevent a coefficient which exceeds a possible value before coding from being set as an interpolation coefficient by an interpolation process.

In the present invention, the selecting circuit selects at least coefficients at both ends from coefficients of each frequency band of a dequantized acoustic signal and performs an interpolation process using said coefficients at both ends. Alternatively, coefficients at both ends, a coefficient having the maximum value and a coefficient having the minimum value are selected from coefficients of each frequency band of a dequantized acoustic signal and an interpolation process is performed using said coefficients. In such a structure, it becomes possible to enhance the computational efficiency and the accuracy in the interpolation process.

In the present invention, the absolute value computing circuit computes an absolute value of a coefficient of a frequency band of a dequantized acoustic signal. The selecting circuit selects a plurality of coefficients from coefficients according to an absolute value computed by the absolute value computing circuit. The computing circuit computes an interpolation coefficient of a coefficient, which is not selected, by an interpolation method which uses the plurality of coefficients selected by the selecting circuit. The adding circuit then adds a sign of a corresponding coefficient to the interpolation coefficient computed by the computing circuit. Since interpolation is performed after the absolute value is computed as described above, it becomes possible to enhance the accuracy of the interpolation process. Moreover, since the sign of a coefficient is added after the interpolation process, it becomes possible to reproduce sound which is closer to the original sound.

In the present invention, the correlation degree computing circuit computes a degree of correlation between a plurality of coefficients adjacent to a coefficient of a frequency band of a dequantized acoustic signal and a plurality of orthogonal transform coefficients read out from a coefficient storage which stores a sine orthogonal transform (e.g., MDCT) coefficient when said coefficient is zero. The sign extracting circuit then extracts a sign of a corresponding orthogonal transform coefficient to a plurality of orthogonal transform coefficients having a high degree of correlation obtained by the correlation degree computing circuit. The adding circuit is constructed to then add a sign extracted by the sign extracting circuit to a corresponding interpolation coefficient to the coefficient computed by the computing circuit when a coefficient of a frequency band is zero. As described above, it becomes possible to compute a degree of correlation with a sine orthogonal transform coefficient having regularity and add a most possible sign even when a sign is lost in quantization.

In the present invention wherein the modifying circuit modifies an interpolation coefficient computed by the computing circuit to zero when said interpolation coefficient has a negative sign, it becomes possible to prevent occurrence of a negative interpolation coefficient which should not exist in nature in an interpolation process based on an absolute value.

A signal processing method according to the present invention for processing an acoustic signal obtained by dequantizing a coded acoustic signal comprises: an index value computing step of computing a tonality index value indicative of a degree of tonality of a dequantized acoustic signal; a tonality judging step of determining whether an acoustic signal is a pure tone or not by comparing the tonality index value computed in the index value computing step with a prestored reference value; a selecting step of selecting a plurality of coefficients from coefficients of a frequency band of a dequantized acoustic signal; and a computing step of computing an interpolation coefficient of a coefficient, which is not selected in the selecting step, by an interpolation method which uses the plurality of coefficients selected in the selecting step when it is not determined in the tonality judging step that the acoustic signal is a pure tone.

A signal processing method according to the present invention for processing an acoustic signal obtained by dequantizing a coded acoustic signal comprises: a bit rate comparing step of determining whether a bit rate of an acoustic signal is smaller than a prestored reference bit rate or not; a selecting step of selecting a plurality of coefficients from coefficients of a frequency band of a dequantized acoustic signal; and a computing step of computing an interpolation coefficient of a coefficient, which is not selected in the selecting step, by an interpolation method which uses the plurality of coefficients selected in the selecting step when it is determined in the bit rate comparing step that the bit rate of the acoustic signal is smaller than the reference bit rate.

A signal processing apparatus according to the present invention for processing an acoustic signal obtained by dequantizing a coded acoustic signal comprises: an index value computing circuit for computing a tonality index value indicative of a degree of tonality of a dequantized acoustic signal; a tonality judging circuit for determining whether an acoustic signal is a pure tone or not by comparing the tonality index value computed by the index value computing circuit with a prestored reference value; a selecting circuit for selecting a plurality of coefficients from coefficients of a frequency band of a dequantized acoustic signal; and a computing circuit for computing an interpolation coefficient of a coefficient, which is not selected by the selecting circuit, by an interpolation method which uses the plurality of coefficients selected by the selecting circuit when it is not determined by the tonality judging circuit that the acoustic signal is a pure tone.

A signal processing apparatus according to the present invention for processing an acoustic signal obtained by dequantizing a coded acoustic signal comprises: a bit rate comparing circuit for determining whether a bit rate of an acoustic signal is smaller than a prestored reference bit rate or not; a selecting circuit for selecting a plurality of coefficients from coefficients of a frequency band of a dequantized acoustic signal; and a computing circuit for computing an interpolation coefficient of a coefficient, which is not selected by the selecting circuit, by an interpolation method which uses the plurality of coefficients selected by the selecting circuit when it is determined by the bit rate comparing circuit that the bit rate of the acoustic signal is smaller than the reference bit rate.

A signal processing apparatus according to the present invention further comprises a detecting circuit for detecting a quantization bit rate at a time of quantization of a coefficient of a frequency band of a dequantized acoustic signal, wherein the computing circuit is constructed to compute an interpolation coefficient of a coefficient, the quantization bit rate of which detected by the detecting circuit is equal to or smaller than a predetermined value, by an interpolation method which uses the plurality of coefficients selected by the selecting circuit.

A computer-readable recording medium according to the present invention which records therein a program for causing a computer to process an acoustic signal obtained by dequantizing a coded acoustic signal comprises: an index value computing step of computing a tonality index value indicative of a degree of tonality of a dequantized acoustic signal; a tonality judging step of determining whether an acoustic signal is a pure tone or not by comparing the tonality index value computed in the index value computing step with a prestored reference value; a selecting step of selecting a plurality of coefficients from coefficients of a frequency band of a dequantized acoustic signal; and a computing step of computing an interpolation coefficient of a coefficient, which is not selected in the selecting step, by an interpolation method which uses the plurality of coefficients selected in the selecting step when it is not determined in the tonality judging step that the acoustic signal is a pure tone.

A computer-readable recording medium according to the present invention which records therein a program for causing a computer to process an acoustic signal obtained by dequantizing a coded acoustic signal comprises: a bit rate comparing step of determining whether a bit rate of an acoustic signal is smaller than a prestored reference bit rate or not; a selecting step of selecting a plurality of coefficients from coefficients of a frequency band of a dequantized acoustic signal; and a computing step of computing an interpolation coefficient of a coefficient, which is not selected in the selecting step, by an interpolation method which uses the plurality of coefficients selected in the selecting step when it is determined in the bit rate comparing step that the bit rate of the acoustic signal is smaller than the reference bit rate.

In the present invention, the index value computing circuit computes a tonality index value indicative of a degree of tonality of a dequantized acoustic signal. The tonality judging circuit determines whether an acoustic signal is a pure tone or not by comparing the tonality index value computed by the index value computing circuit with a prestored reference value. The selecting circuit selects a plurality of coefficients from coefficients of a frequency band of a dequantized acoustic signal. The computing circuit then computes an interpolation coefficient of a coefficient, which is not selected, by an interpolation method which uses the plurality of coefficients selected by the selecting circuit when it is not determined by the tonality judging circuit that the acoustic signal is a pure tone. Accordingly, it is possible to determine whether an interpolation coefficient is to be computed or not independently in decoding and it becomes possible to suitably compute an interpolation coefficient for various specifications only when the tonality is low. Moreover, a coefficient which is not selected in a frequency band of an acoustic signal is interpolated smoothly, that is, the resolution of a quantized coefficient can be enhanced, and reproduction without dissatisfaction or uncomfortable feeling can be achieved.

In the present invention, the bit rate comparing circuit determines whether a bit rate of an acoustic signal is smaller than a prestored reference bit rate or not. The selecting circuit selects a plurality of coefficients from coefficients of a frequency band of a dequantized acoustic signal. The computing circuit then computes an interpolation coefficient of a coefficient, which is not selected, by an interpolation method which uses the plurality of coefficients selected by the selecting circuit when it is determined by the bit rate comparing circuit that the bit rate of the acoustic signal is smaller than the reference bit rate. Accordingly, it is possible to determine whether an interpolation coefficient is to be computed or not independently in decoding and it becomes possible to suitably compute an interpolation coefficient for various specifications only when the tonality is low. Moreover, a coefficient which is not selected in a frequency band of an acoustic signal is interpolated smoothly, that is, the resolution of a quantized coefficient can be enhanced, and reproduction without dissatisfaction or uncomfortable feeling can be achieved.

In the present invention, the detecting circuit detects a quantization bit rate at a time of quantization of a coefficient of a frequency band of a dequantized acoustic signal. The present invention is constructed to then compute an interpolation coefficient of a coefficient, the quantization bit rate of which detected by the detecting circuit is equal to or smaller than a predetermined value, by an interpolation method which uses the plurality of coefficients selected by the selecting circuit. Accordingly, it is possible to perform an interpolation process in a concentrated manner for a coefficient having a small quantization bit rate and a large quantization error and it becomes possible to reproduce a more accurate signal.

The above and further objects and features of the invention will more fully be apparent from the following detailed description with accompanying drawings.

BRIEF DESCRIPTION OF THE SEVERAL VIEWS OF THE DRAWINGS

FIG. 16 is an explanatory view showing the record layout of a table;

FIG. 20 is an explanatory view showing the record layout of a coefficient storage;

DESCRIPTION OF THE PREFERRED EMBODIMENTS

Embodiment 1

Figure 1:
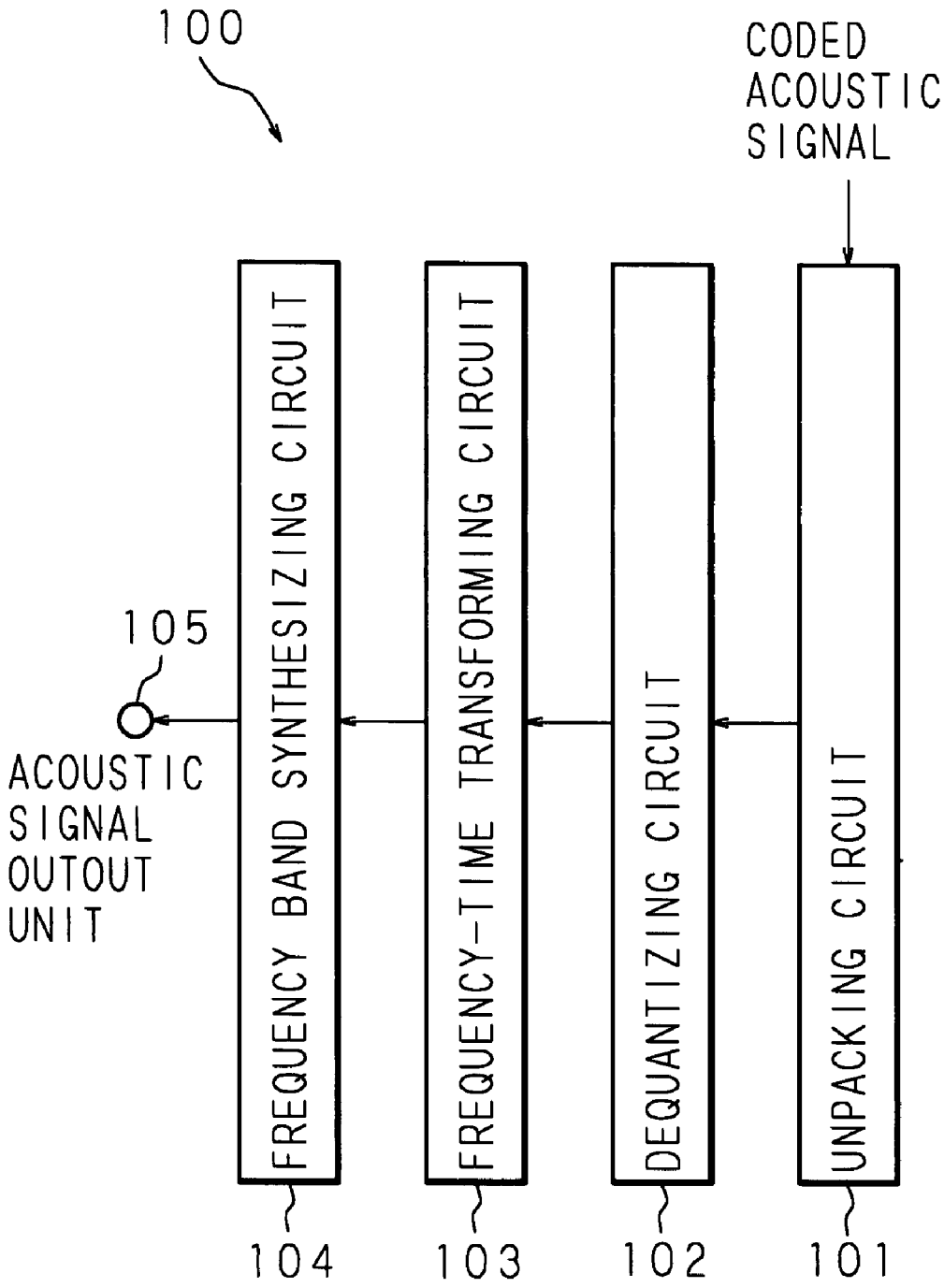
FIG. 1 PRIOR ART
FIG. 1 is a block diagram showing the hardware structure of a conventional decoding apparatus.
Figure 2:
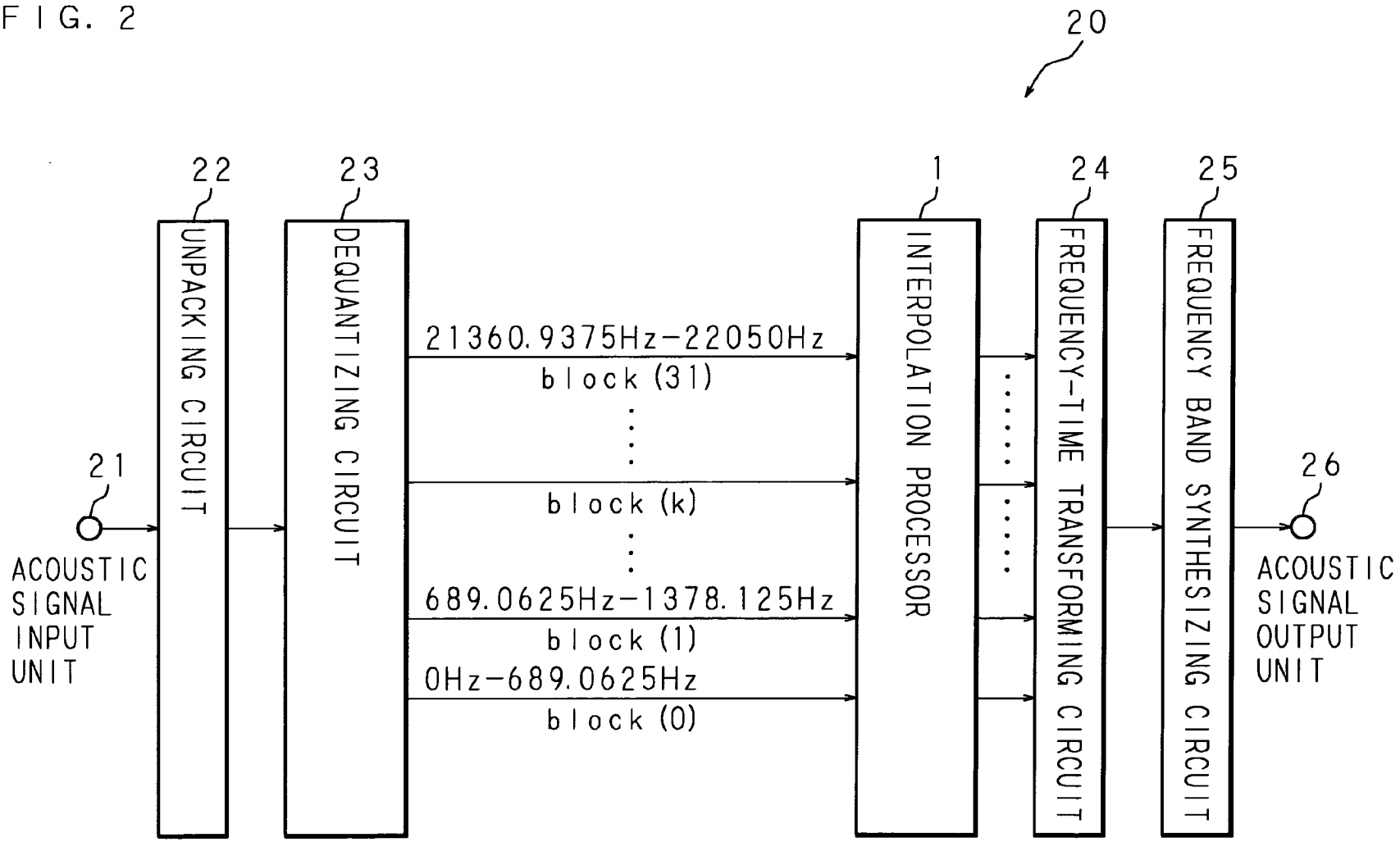
FIG. 2 is a block diagram showing the hardware structure of a decoding apparatus which is a signal processing apparatus.

The following description will explain an embodiment of the present invention with reference to the drawings. FIG. 2 is a block diagram showing the hardware structure of a decoding apparatus which is a signal processing apparatus. Denoted at 20 in the figure is a decoding apparatus for decoding a coded acoustic signal and comprises an acoustic signal input unit 21, an unpacking circuit 22, a dequantizing circuit 23, an interpolation processor 1, a frequency-time transforming circuit 24, a frequency band synthesizing circuit 25 and an acoustic signal output unit 26. It should be noted that, though the present embodiment is explained using an example wherein the MP3 is applied as a compression coding method, other methods may be applied similarly.

A coded acoustic signal read out from recording medium, a coded acoustic signal received by a digital tuner or the like is inputted into the acoustic signal input unit 21, and the inputted coded acoustic signal is outputted to the unpacking circuit (demultiplexer) 22. The unpacking circuit 22 unpacks the quantization coefficient, the scale factor, the scale factor multiplexer, the global gain and the subblock gain respectively from frame information of the acoustic signal. The coded acoustic signal is dequantized into an IMDCT coefficient at the dequantizing circuit 23 using the unpacked quantization coefficient, the quantization bit rate, the scale factor, the scale factor multiplexer, the global gain and the subblock gain. The dequantizing circuit 23 outputs an IMDCT coefficient expressed by the next expression (1) for each frequency band depending on the block length (a long block or a short block).

Long block: (1)

$$I(m) = sgn(MK(m)) \times |MK(m)|^{\frac{4}{3}} \times \ldots 2^{\frac{1}{4}(\text{global_gain}[gr]-210)} \times 2^{-(\text{scalefac_multiplier} \times (scalefac[sfb] + preflag[gr] \times pretab[sfb]))}$$

Short block:

$$I(m) = sgn(MK(m)) \times |MK(m)|^{\frac{4}{3}} \times \ldots 2^{\frac{1}{4}(\text{global_gain}[gr]-210-8 \times \text{subblock_gain}[gr][wnd])} \times 2^{-(\text{scalefac_multiplier} \times scalefac[gr][wnd][sfb])}$$

$I(m)$: *IMDCT* coefficient scalefac_multiplier= [1, 0.5]

*gr*:*granule*, *wnd*:window, *sfb*:*scalefactorband*

The variable "m" in the expression (1) indicates the index of the IMDCT coefficient, "MK(m)" indicates the quantization coefficient (Huffman decoding value), "sgn(MK(m))" indicates the sign of the quantization coefficient, "scalefac_multiplier" indicates 1 or 0.5, "gr" indicates the index of granule, "wnd" indicates the index of the form of the window, "sfb" indicates the index of the scale factor band, "preflag[gr]" indicates an existence flag of the preemphasis which is 0 or 1, and "pretab[sfb]" indicates a value obtained by a predetermined preemphasis table. It should be noted that the scale factor (which can be represented by each six bits and designated by approximately 2 dB, for example) in ATRAC is the same as a value relating to the scale factor in MP3. The value relating to the scale factor in MP3 is computed using the scale factor, the scale factor multiplexer, the global gain, the subblock gain (a part of the expression (1) after the multiplier of 2), the existence flag of the preemphasis and a value obtained by the preemphasis table, as shown in the expression (1). The following description will explain the scale factor in ATRAC and values relating to the scale factor in MP3 collectively as a scale factor. Here, the scale factor means a characteristic part represented by a mantissa part and an exponent part in order to represent a spectrum of each predetermined frequency band which is divided. For example, in MP3, a spectrum of each predetermined frequency band which is divided is normalized to have the maximum value of 1.0, and the characteristic part thereof is coded as a scale factor, a global gain and a subblock gain. The scale factor, the global gain and the exponent part of the subblock gain mentioned above are named generically as a value relating to a scale factor.

In the present embodiment, IMDCT coefficients I(0), I(1), . . . , I(m), . . . , I(575) are outputted for each of 32 frequency bands block (0)-block (31) as shown in the figure. When the sampling frequency is 44.1 kHz, the frequency of a block (0) is 0 Hz-689.0625 Hz, a block (1) is 689.0625 Hz-1378.125 Hz and a block (31) is 21360.9375 Hz-22050 Hz. It should be noted that a block of an arbitrary frequency band is hereinafter referred to as a block (k). Here, "k" is an integer and satisfies $0 \leqq k \leqq 31$. The IMDCT coefficients I(0)-I(575) for each frequency band are inputted into the interpolation processor 1.

An IMDCT coefficient for each frequency band is composed of a plurality of coefficients (spectrums) depending on the block length. An IMDCT coefficient of a long block is composed of 18 coefficients and an IMDCT coefficient of a short block is composed of 6 coefficients. It should be noted that the following description will explain the present embodiment using an example wherein the block length is a long block.

Figure 3:
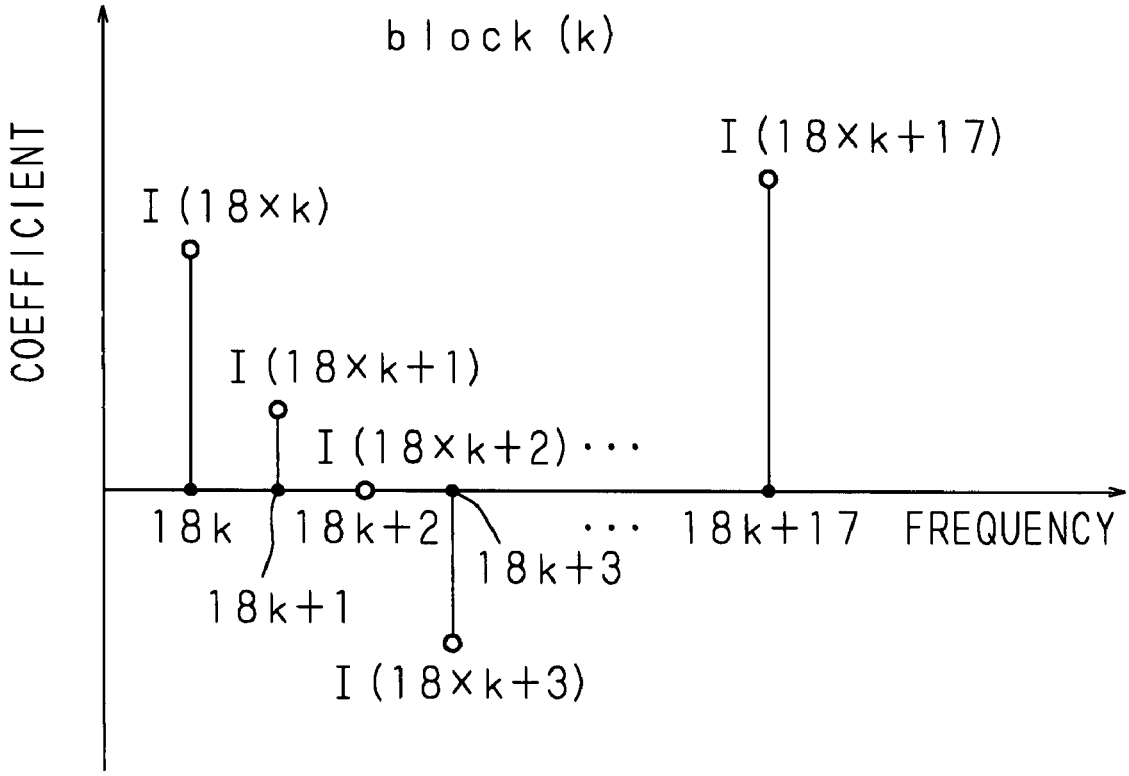
FIG. 3 is a graph showing a change in an IMDCT coefficient to a frequency.

FIG. 3 is a graph showing a change in an IMDCT coefficient to a frequency. The frequency is shown on the abscissa axis and the coefficient is shown on the ordinate axis. When the IMDCT coefficient (which will be hereinafter represented by a coefficient I(m)) is a long block, 18 coefficients I(18×k) to I(18×k+17) are included in a frequency band. In the graph of FIG. 3, a change in the coefficients I(18×k), I(18×k+), . . . , I(18×k+17) is shown with respect to frequencies 18×k, 18×k+1, . . . , 18×k+17. The coefficient takes a positive, negative or null value.

In FIG. 2, the coefficient I(m) is inputted into the interpolation processor 1, and a coefficient which has undergone an interpolation process is outputted from the interpolation processor 1. The frequency-time transforming circuit 24 applies an IMDCT process so as to transform the coefficient into an acoustic signal on a time axis. The inverted acoustic signal further undergoes band synthesis by an IPFB (Inverse Polyphase Filter Bank), which is a band synthesizing filter, at the frequency band synthesizing circuit 25 and then outputted to the acoustic signal output unit 26.

Figure 4:
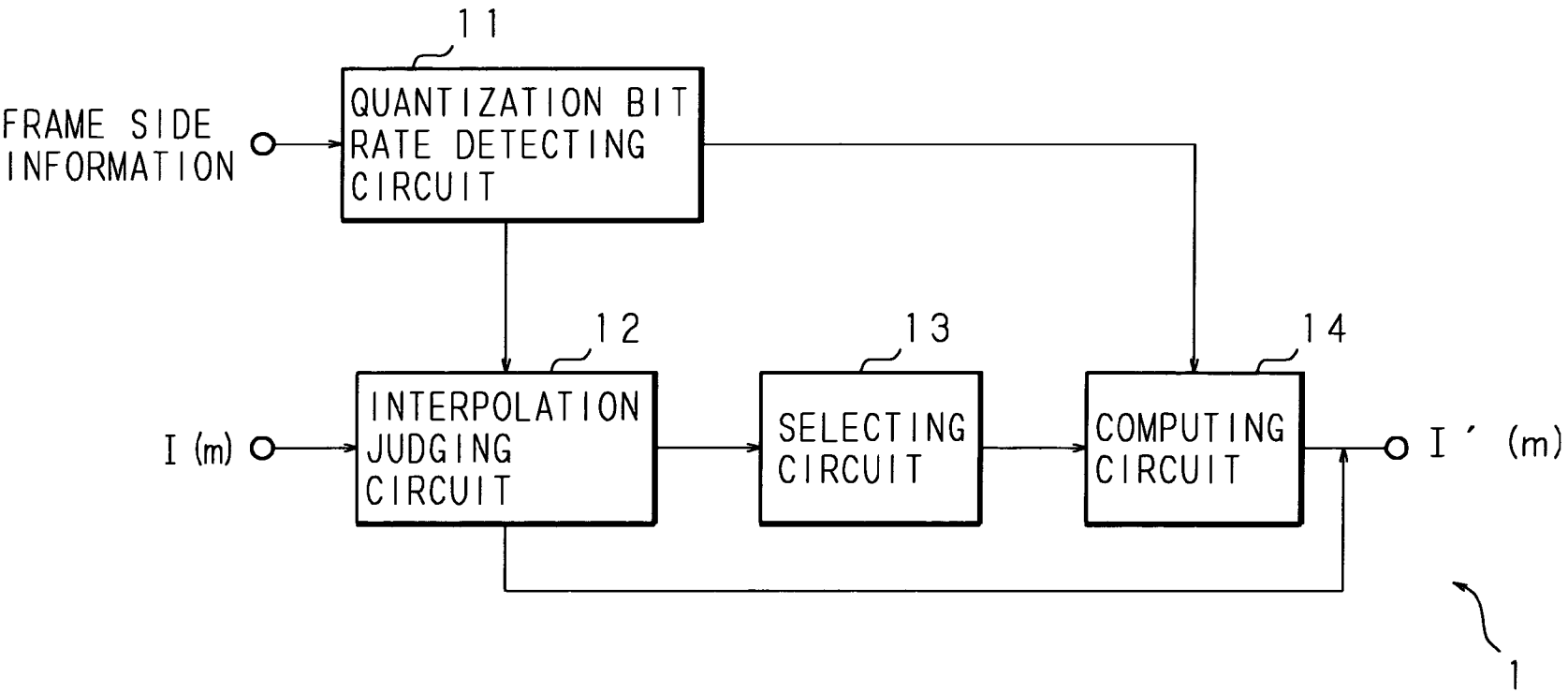
FIG. 4 is a block diagram showing the hardware structure of an interpolation processor.

FIG. 4 is a block diagram showing the hardware structure of the interpolation processor 1. The interpolation processor 1 comprises a quantization bit rate detecting circuit 11, an interpolation judging circuit 12, a selecting circuit 13 and a computing circuit 14. The quantization bit rate detecting circuit 11 detects the quantization bit rate at the time of quantization of a coefficient of a frequency band based on inputted frame side information. In particular, the quantization bit rate of a coefficient I(m) can be detected by referring to table_select[ch][gr][region] of frame side information in a bit stream which is unpacked by the unpacking circuit 22. Said table_select[ch][gr][region] is a select signal which indicates a Huffman table which has undergone Huffman coding, and a Huffman decoded value, i.e. a coefficient I(m), can be obtained by decoding the indicated Huffman table. Since the maximum digit existing in the Huffman table indicated by table_select[ch][gr][region] is preliminarily decided, the quantization bit rate is detected from the word length thereof, though the quantization bit rate can be detected by obtaining the maximum digit of a Huffman coded value of an area at said region.

The quantization bit rate detecting circuit 11 outputs the detected quantization bit rate to the interpolation judging circuit 12 and the computing circuit 14. The interpolation judging circuit 12 determines whether there is a coefficient I(m) having a quantization bit rate equal to or smaller than a predetermined bit rate in a frequency band or not. The interpolation judging circuit 12 may determine, for example, whether there is a coefficient I(m) having a quantization bit rate equal to or smaller than 4 in a frequency band or not. Then, when determining that there is a coefficient I(m) having a quantization bit rate equal to or smaller than a predetermined bit rate in an inputted frequency band, the interpolation judging circuit 12 outputs a coefficient I(m) of said frequency band to the selecting circuit 13 in order to apply an interpolation process. On the other hand, when determining that there is not a coefficient I(m) having a quantization bit rate equal to or smaller than a predetermined quantization bit rate in an inputted frequency band, the interpolation judging circuit 12 outputs a corrected coefficient I'(m) to the frequency-time transforming circuit 24 without applying an interpolation process to the coefficient I(m) of said frequency band.

The selecting circuit 13 selects a plurality of coefficients from coefficients in a frequency band. Here, for example, selected are at least coefficients at both ends of coefficients in a frequency band, i.e., a frequency at the lowest region and a frequency at the highest region. In the example of FIG. 3, selected are I(18×k) and I(18×k+7). The selecting circuit 13 may further select a coefficient having the largest spectrum and a coefficient having the smallest spectrum, in addition to the coefficients at both ends, from coefficients in the frequency band. In the example of FIG. 3, selected are I(18×k+3), which is the minimum spectrum, and a coefficient I(18×k+17), which is the maximum spectrum and exists at the highest region. The selecting circuit 13 outputs information relating to the plurality of selected coefficients and the inputted coefficients I(m) to the computing circuit 14.

The computing circuit 14 computes an interpolation coefficient of a coefficient, which is not selected, by an interpolation method using the coefficients selected by the selecting circuit 13. In this case, the computing circuit 14 may compute an interpolation coefficient only for a coefficient having a quantization bit rate equal to or smaller than a predetermined quantization bit rate, based on the quantization bit rate of the coefficient outputted from the quantization bit rate detecting circuit 11. As the interpolation method, a Lagrange's interpolation method or a spline interpolation method is used. The following description will explain an example wherein the spline interpolation method is used.

N+1 points (x0, y0), (x1, y1), . . . , (xN, yN) are given. Here, x0<x1< . . . xN is satisfied. The spline interpolation for connecting these points smoothly will be described. A curve to be obtained by a cubic spline interpolation is expressed by y=S(x). S(x) is defined piecewise by each section [xj, yj]. S(x)=Sj(x) is satisfied in each section xj≦x≦xj+1. Sj(x) is given by a cubic polynomial expressed by the expression (2).

$$S_j(x)=a_j(x-x_j)^3+b_j(x-x_j)^2+c_j(x-x_j)+d_j \tag{2}$$

Coefficients aj, bj, cj and dj are decided by the following conditions. That is, the curve y=S(x) is continuous and passes all the points (xJ, yJ)(j=0, 1, . . . , N) (condition 1). Moreover, the first-order differential coefficient and the second-order differential coefficient of y=S(x) are continuous at boundaries of sections x=xj(j=1, 2, . . . , N−1) (condition 2). From the condition 1, the expression (3) is derived.

$$S_j(x_j)=y_j(j=0, 1, \ldots, N-1)$$

$$S_j(x_{j+1})=y_j+1(j=0, 1, \ldots, N-1) \tag{3}$$

From the condition 2, the expression (4) is derived.

$$S'_j(x_{j+1})=S'_{j+1}(x_{j+1})\ (j=0, 1, \ldots, N-1)$$

$$S''_j(x_{j+1})=S''_{j+1}(x_{j+1})\ (j=0, 1, \ldots, N-1) \tag{4}$$

Using these expressions (3) and (4), the coefficients aj, bj, cj and dj are decided. First, the second-order differential coefficient of S(x) at x=xj(j=1, 2, . . . , N−1) is expressed as the expression (5).

$$u_j=S''(x_j) \tag{5}$$

Since the definition of the cubic spline is the expression (2), the second-order differential coefficient thereof is expressed by the expression (6).

$$S''_j(x_j)=2b_j=u_j \tag{6}$$

Thus, bj=uj/2 is obtained. Furthermore, the second-order differential coefficient can be expressed by the expression (7).

$$S''_j(x_{j+1})=6a_j(x_{j+1}-x_j)+2b_j=u_{j+1} \tag{7}$$

From the expression (7), the expression (8) is derived.

$$a_j=\frac{u_{j+1}-u_j}{6(x_{j+1}-x_j)} \tag{8}$$

From the above expression, the conditions of the expression (9) is satisfied automatically.

$$S''_j(x_{j+1})=u_{j+1}=S''_{j+1}(x_{j+1}) \tag{9}$$

Since dj=yj is clear, the expression (10) is derived using the condition 1.

$$a_j(x_{j+1}-x_j)^3+b_j(x_{j+1}-x_j)^2+c_j(x_{j+1}-x_j)+d_j=y_j \tag{10}$$

Furthermore, the expression (11) is obtained finally from the expression (10).

$$c_j=\frac{y_{j+1}-y_j}{x_{j+1}-x_j}-\frac{1}{6}(x_{j+1}-x_j)(2u_j+u_{j+1}) \tag{11}$$

Here, the last condition expressed by the expression (12) is used.

$$S''_j(x_{j+1})=S'_{j+1}(x_{j+1}) \tag{12}$$

The expression (12) can be expressed as the expression (13) from a cubic polynomial.

$$3a_j(x_{j+1}-x_j)^2+2b_j(x_{j+1}-x_j)+c_j=c_{j+1} \tag{13}$$

By assigning aj, bj and cj into the expression (13), the expression (14) is derived.

$$\begin{aligned}(x_{j+1}-x_j)u_j+2(x_{j+2}-x_j)u_{j+1}+\\(x_{j+2}-x_{j+1})u_{j+2}\end{aligned}=6\left\{\frac{y_{j+2}-y_{j+1}}{x_{j+2}-x_{j+1}}-\frac{y_{j+1}-y_j}{x_{j+1}-x_j}\right\} \tag{14}$$

When these are arranged in order, simultaneous equations expressed by the expression (15) are satisfied.

$$\begin{cases} h_0u_0+2(h_0+h_1)u_i+h_1u_2=v_1 \\ h_1u_1+2(h_1+h_2)u_2+h_2u_3=v_2 \\ \ldots \\ h_{N-2}u_{N-2}+2(h_{N-2}+h_{N-1})u_{N-1}+h_{N-1}u_N=v_{N-1} \end{cases} \tag{15}$$

Here, hj and vj satisfy the condition expressed by the following expression (16). It should be noted that hj and vj are known constants which can be computed only from xj and yj which are given at first.

$$\begin{aligned} &h_j=x_{j+1}-x_j \\ &(j=0, 1, \ldots, N-1) \\ &v_i=6\left\{\frac{y_{j+1}-y_j}{h_j}-\frac{y_j-y_{j-1}}{h_{j-1}}\right\} \\ &(j=1, 2, \ldots, N-1) \end{aligned} \tag{16}$$

Though the number of unknown variables uj is N+1, the number of the simultaneous linear equations described above is N−1. Accordingly, uj cannot be decided uniquely from the simultaneous linear equation. Therefore, a boundary condition is added at each of the points (x0, y0) and (xN, yN) at both ends of the curve. Though some boundary conditions are possible, a condition that the rate of change in slope of the curve is 0 at both ends is employed here. Since the second-order differential is 0, the expression (17) is derived.

$$S''(x_0)=S''(x_N)=0 \tag{17}$$

From the expression (17), the expression (18) is derived.

$$S''(x_0)=S''_{N-1}(x_N)=0 \tag{18}$$

Since u0=uN=0 is satisfied, the simultaneous linear equation relating to u1 to uN−1 expressed by the expression (19) is obtained.

$$\begin{bmatrix} 2(h_0+h_1) & h_1 & & & \\ h_1 & 2(h_1+h_2) & h_2 & 0 & \\ & \ddots & \ddots & \ddots & \\ & 0 & h_{N-3} & 2(h_{N-3}+h_{N-2}) & h_{N-2} \\ & & & h_{N-2} & 2(h_{N-2}+h_{N-1}) \end{bmatrix} \begin{bmatrix} u_1 \\ u_2 \\ \vdots \\ u_{N-2} \\ u_{N-1} \end{bmatrix} = \begin{bmatrix} v_1 \\ v_2 \\ \vdots \\ v_{N-2} \\ v_{N-1} \end{bmatrix} \tag{19}$$

Next, the following description will explain the algorithm of the spline interpolation. First, N+1 points (xJ, yJ) (j=0, 1, . . . , N) are given and it is assumed that the cubic spline satisfies the expressions (20) and (21) piecewise.

$$S(x)=S_j(x)=a_j(x-x_j)^3+b_j(x-x_j)^2+c_j(x-x_j)+d_j(x_j\leqq x\leqq x_{j+1}) \tag{20}$$

$$S''(x_j)=u_j(j=0, 1, \ldots, N) \tag{21}$$

When the boundary condition at both ends of the curve is the expression (22), u0=uN=0 is satisfied.

$$S''(x_0)=S''(x_N)=0 \tag{22}$$

By computing hj (j=0, 1, . . . , N) and uj (j=0, 1, . . . , N) and solving the simultaneous linear equation, u1 to uN−1 are obtained. At last, coefficients aj, bj, cj and dj are obtained and the curve S(x) is decided. The computing circuit 14 obtains coefficients aj, bj, cj and dj of the curve Sj(x) based on the coefficients selected by the selecting circuit 13. Regarding a coefficient which is not selected and has a quantization bit rate equal to or smaller than a predetermined value, an interpolation coefficient Sj(x) is computed and a corrected interpolation coefficient Sj(x) and a coefficient which is not interpolated are outputted to the frequency-time transforming circuit 24 as coefficients I'(m).

Figure 5:
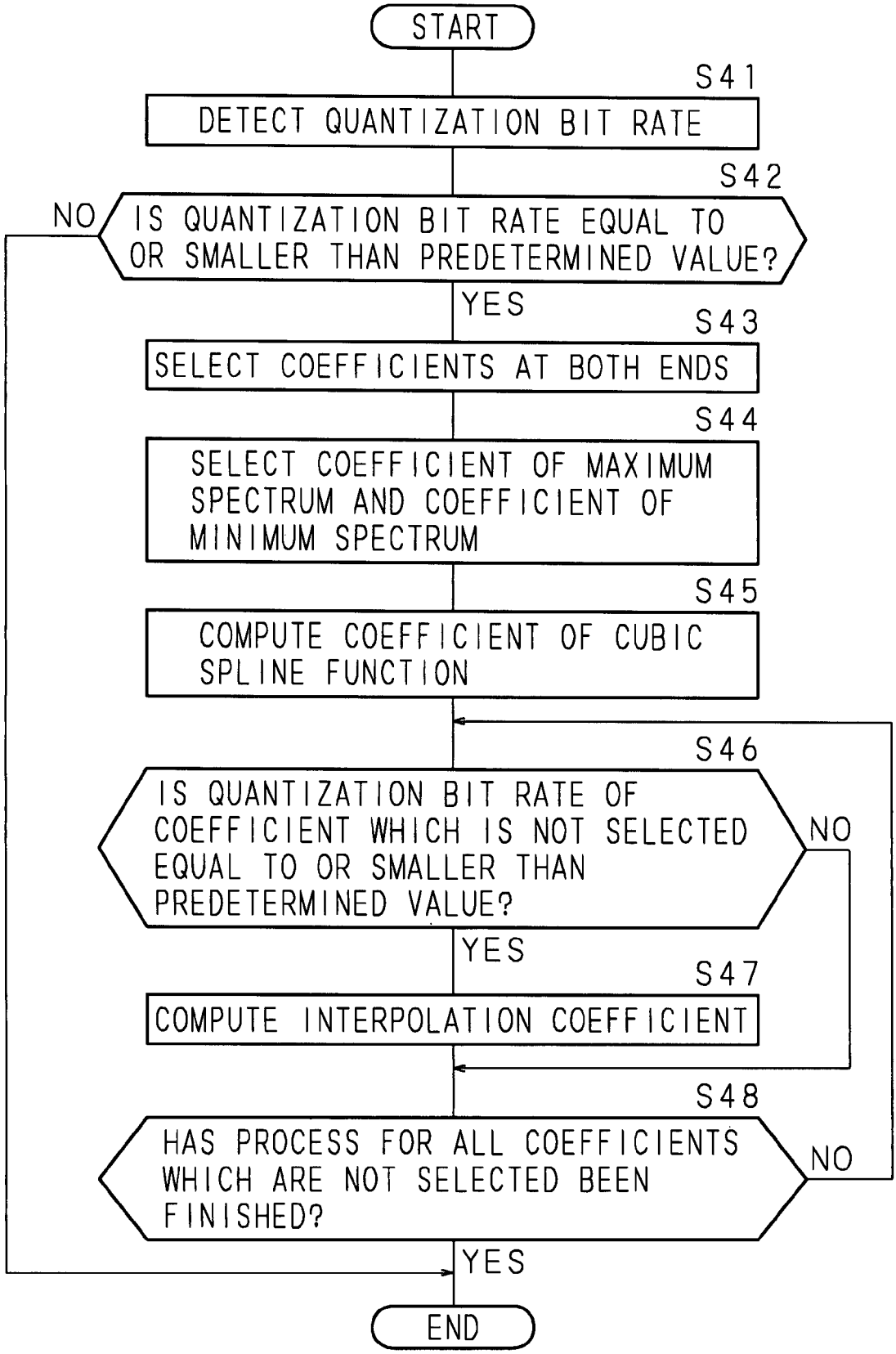
FIG. 5 is a flow chart showing the procedure of an interpolation process.

FIG. 5 is a flow chart showing the procedure of an interpolation process. It should be noted that the following description will explain an example where the block length of coefficients in a frequency band is a long block, for ease of explanation. First, the quantization bit rate detecting circuit 11 detects the quantization bit rate (step S41). The detected quantization bit rate is outputted respectively to the interpolation judging circuit 12 and the computing circuit 14. The interpolation judging circuit 12 determines whether there is a coefficient having a quantization bit rate equal to or smaller than a predetermined value in coefficients of a frequency band or not (step S42). When determining that there is not a coefficient having a quantization bit rate equal to or smaller than a predetermined value (NO in the step S42), the interpolation judging circuit 12 terminates a sequence of processes. In this case, the interpolation judging circuit 12 outputs coefficients of said frequency band to the frequency-time transforming circuit 24.

On the other hand, when determining that there is a coefficient having a quantization bit rate equal to or smaller than a predetermined value (YES in the step S42), the interpolation judging circuit 12 outputs coefficients of said frequency band to the selecting circuit 13. The selecting circuit 13 selects coefficients at both ends in the frequency band, i.e. a coefficient at the low region side and a coefficient at the high region side, as nodal points of the spline interpolation (step S43). The selecting circuit 13 further selects a coefficient of the maximum spectrum and a coefficient of the minimum spectrum of coefficients in the frequency band as nodal points of the spline interpolation (step S44). It should be noted that the number of nodal points becomes 2 to 4 since the coefficient of the maximum spectrum and the coefficient of the minimum spectrum may be respectively coefficients at both ends in the frequency band.

The computing circuit 14 computes the coefficients aj, bj, cj and dj of the spline function based on coefficients selected in the steps S43 and S44 expressed by the expression (2) (step S45). The computing circuit 14 determines whether the quantization bit rate of a coefficient which is not selected in the steps S43 and S44 is equal to or smaller than a predetermined value or not (step S46). When determining that the quantization bit rate of a coefficient which is not selected is equal to or smaller than a predetermined value (YES in the step S46), the computing circuit 14 computes an interpolation coefficient from the obtained coefficients aj, bj, cj and dj and the expression (2) (step S47). On the other hand, when determining that the quantization bit rate of a coefficient which is not selected is not equal to nor smaller than a predetermined value (NO in the step S46), the computing circuit 14 does not perform the interpolation process and skips the process at the step S47.

The computing circuit 14 determines whether the process of the step S46 for all the coefficients which are not selected in the steps S43 and S44 has been finished or not (step S48). When determining that the process has not been finished (NO in the step S48), the computing circuit 14 proceeds to the step S46 so as to obtain an interpolation coefficient for another coefficient which is not selected. On the other hand, when determining that the process for all the coefficients which are not selected has been finished (YES in the step S48), the computing circuit 14 terminates a sequence of processes. As a result of executing the above process for all frequency bands and applying the spline interpolation for coefficients having a low quantization bit rate so as to obtain the most suitable spectrum as an interpolation coefficient, the resolution of a quantized coefficient can be enhanced and reproduction without dissatisfaction or uncomfortable feeling can be achieved. It should be noted that the selecting method of a coefficient to be a nodal point and the value of the quantization bit rate described above are absolutely an example and the present invention is not limited to them.

It should be noted that the selecting circuit 13 may select a coefficient of the maximum spectrum and a coefficient of the minimum spectrum from coefficients of a frequency band in the step S44 only when the following condition is satisfied. That is, the coefficient of the maximum spectrum and the coefficient of the minimum spectrum are selected when the quantization bit rate of the coefficient of the maximum spectrum and the coefficient of the minimum spectrum is equal to or larger than a predetermined value in the step S46, e.g., 4 bit.

Figures 6A, 6B, 6C:
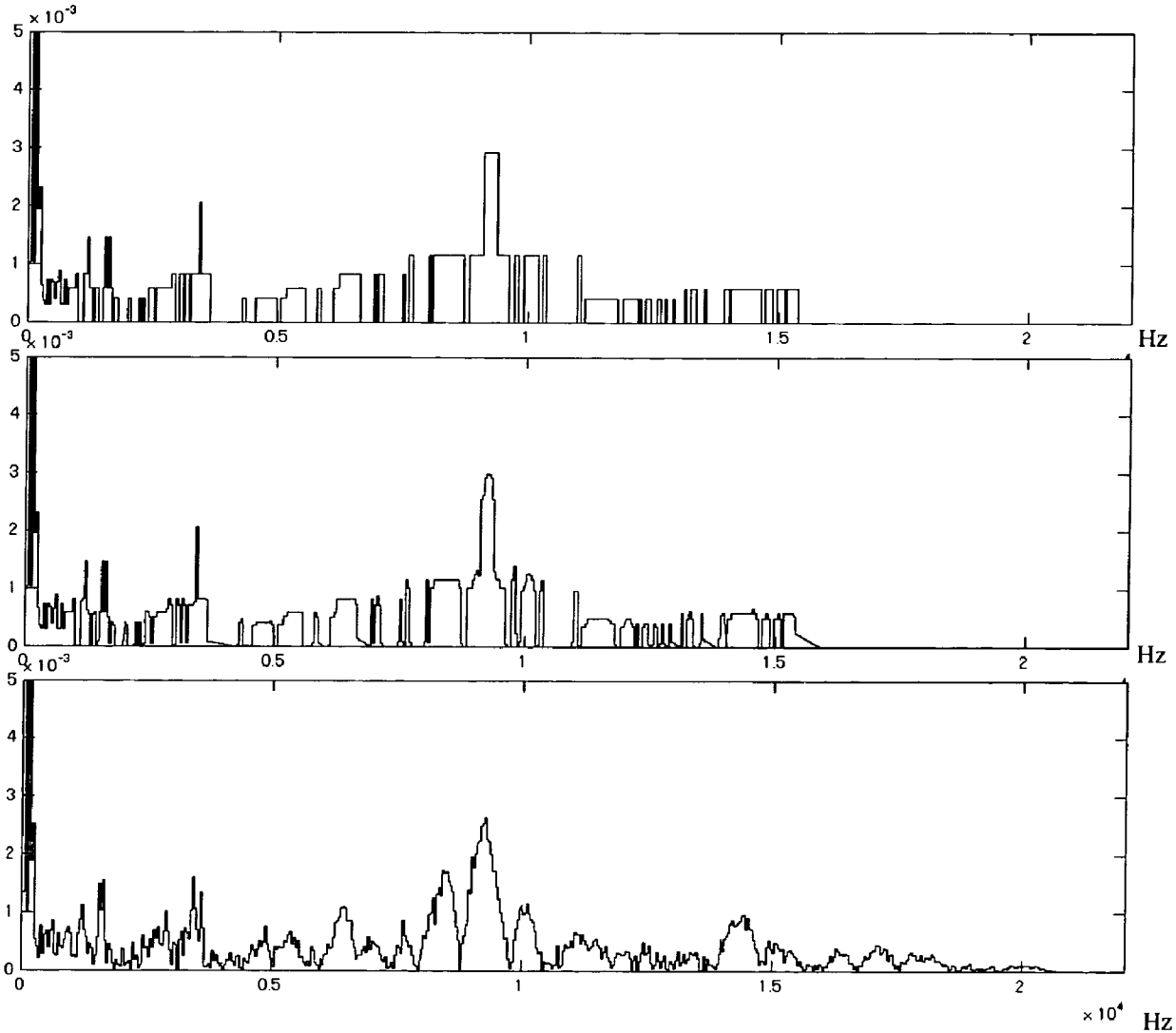
FIGS. 6A, 6B and 6C are graphs for verifying the result of the interpolation process.

FIGS. 6A, 6B and 6C are graphs for verifying the result of the interpolation process. FIG. 6C is a graph showing a change in an MDCT coefficient for a frequency of the original sound. In FIG. 6C, a frequency (the unit is Hz) is shown on the abscissa axis and the absolute value of an MDCT coefficient before coding (the scale is $5\times10^{-3}$) is shown on the ordinate axis. FIG. 6A shows a change in a coefficient (IMDCT coefficient) for a frequency of a case where the process by the interpolation processor 1 in FIG. 2 is not applied to the original sound. In FIG. 6A, a frequency (the unit is Hz) is shown on the abscissa axis and the absolute value of the IMDCT coefficient (I(m)) (the scale is $5\times10^{-3}$) is shown on the ordinate axis.

As shown in FIG. 6A, the quantized value of the level of the spectrum for the original sound becomes uniform, and some rounding errors due to quantization and some absences of the spectrum due to a quantization bit rate of 0 are found all over the area. On the other hand, FIG. 6B shows a change in a coefficient (IMDCT coefficient) for a frequency to which a process by the interpolation processor 1 has been applied. In FIG. 6B, a frequency (the unit is Hz) is shown on the abscissa axis and the absolute value of an IMDCT coefficient (I'(m)) (the scale is $5\times10^{-3}$) is shown on the ordinate axis. In comparison with FIG. 6A, it can be understood that the wave form is approximate to the original sound. In particular, when the coefficient undergoes a great change, a wave form in FIG. 6B by spline interpolation is reproduced smoothly in comparison with FIG. 6A, that is, a wave form closer the original sound is reproduced.

Embodiment 2

Figure 7:
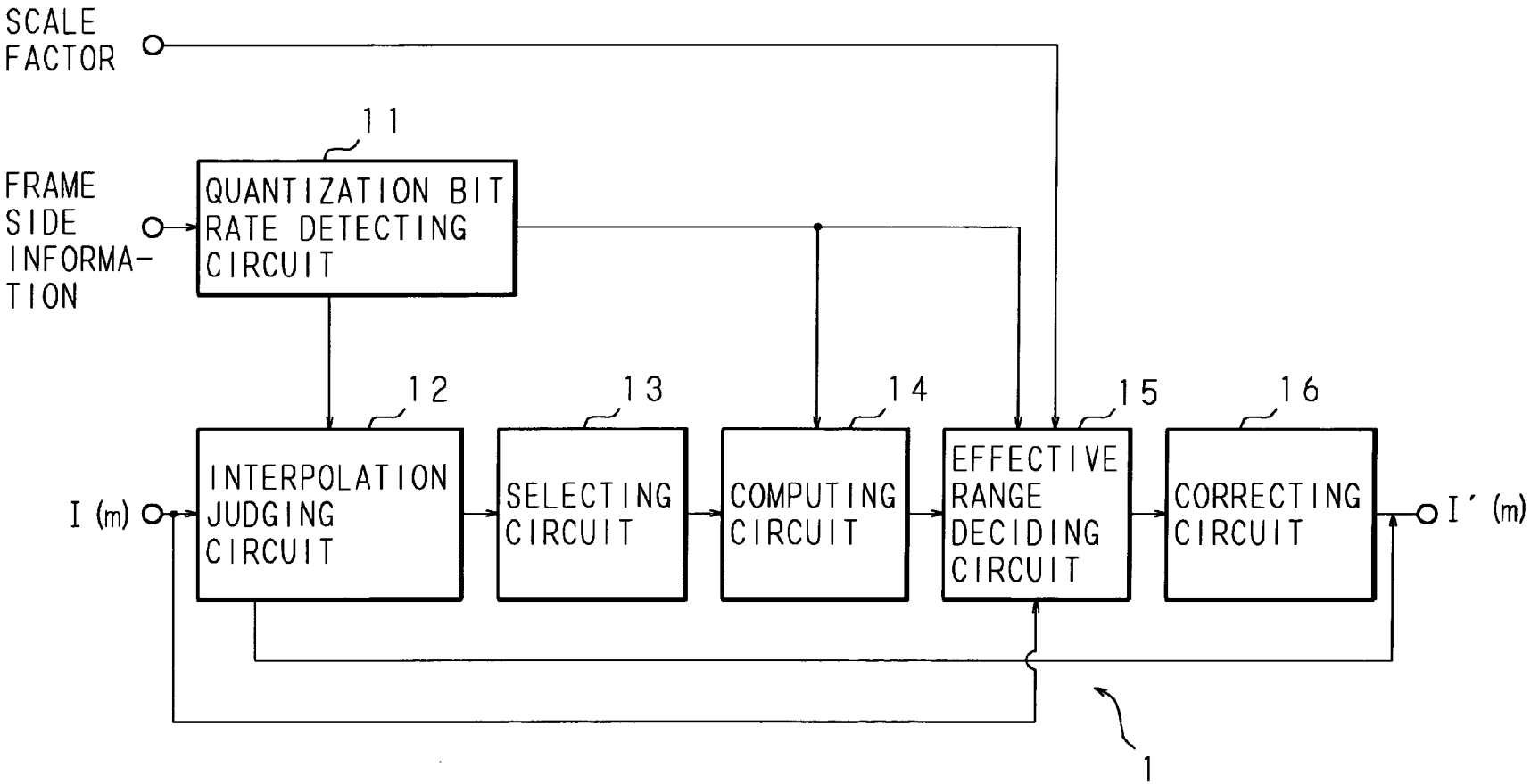
FIG. 7 is a block diagram showing the hardware structure of an interpolation processor according to Embodiment 2.

Embodiment 2 relates to a form for correcting an interpolation coefficient. FIG. 7 is a block diagram showing the hardware structure of an interpolation processor 1 according to Embodiment 2. In addition to the structure of Embodiment 1, an effective range deciding circuit 15 and a correcting circuit 16 are added. A scale factor of each frequency band is extracted from frame side information of a bit stream outputted from the dequantizing circuit 23 and the extracted scale factor is inputted into the effective range deciding circuit 15. The quantization bit rate of a coefficient detected by the quantization bit rate detecting circuit 11 and the interpolation coefficient and the coefficient I(m) computed by the computing circuit 14 are inputted into the effective range deciding circuit 15.

Figure 8:
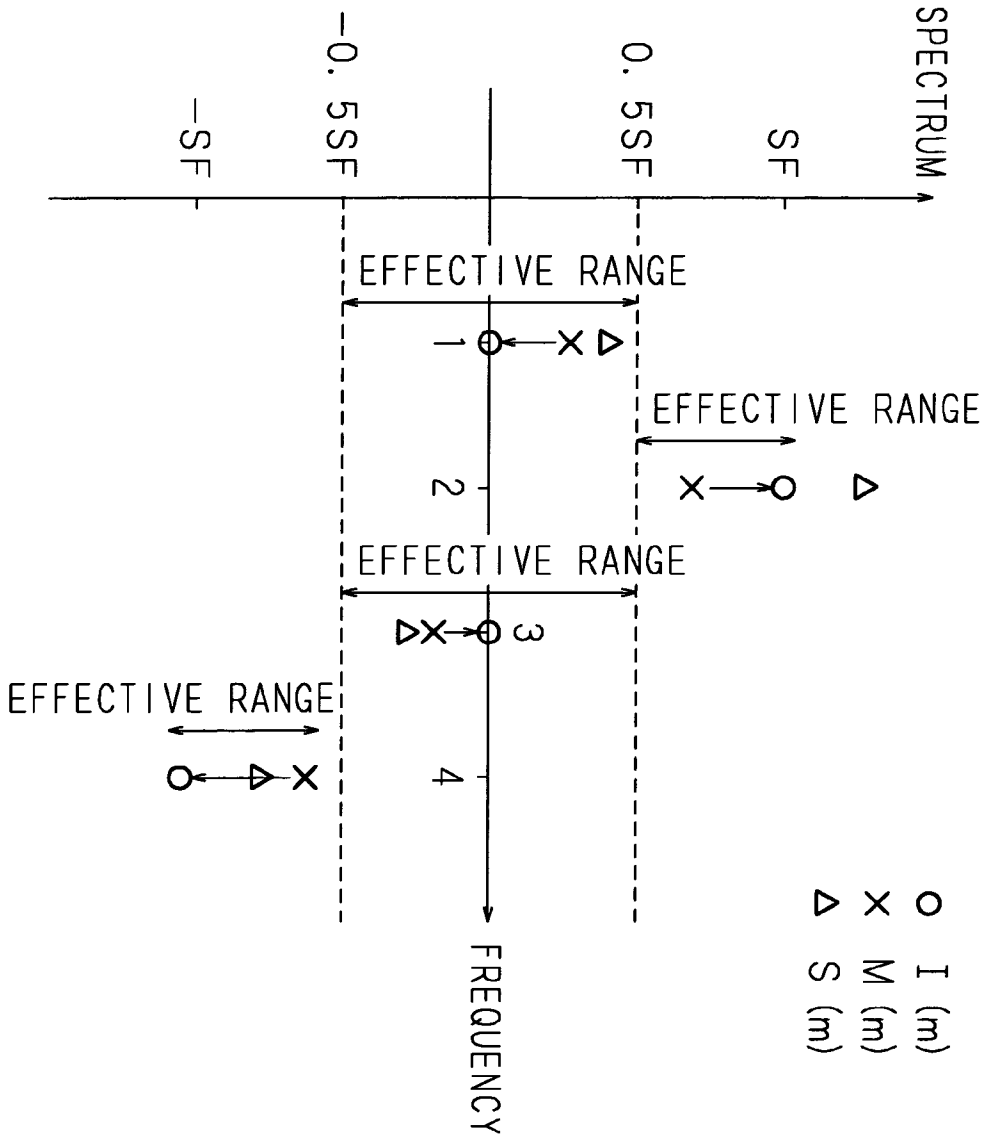
FIG. 8 is a graph for explaining an effective range.

FIG. 8 is a graph for explaining an effective range. In the graph of FIG. 8, a frequency is shown on the abscissa axis and the magnitude of a spectrum is shown on the ordinate axis. Each circle indicates a coefficient I(m) to which interpolation by spline interpolation is not applied. Here, for the purpose of illustration, the number of coefficients satisfies $1\leqq m\leqq 4$, the scale factor is SF and a quantization bit rate is 2. Each x indicates an MDCT coefficient (M(m)) of the original sound. An M(m) of the original sound is quantized to a circle in the direction indicated by the arrow by quantization of 2 bits. For example, M(1), which should be at approximately 0.3SF but is equal to or smaller than 0.5SF, is quantized to I(1)=0SF. M(2), which is larger than 0.5SF, is quantized to I(2)=SF.

Here, in a case of I(1)=0 as shown in the figure, the original sound M(1) having a quantization bit rate of 2 exists theoretically in a range from −0.5SF to +0.5SF. When I(2)=SF is satisfied, the original sound M(2) theoretically exists in a range from a lower limit 0.5SF to an upper limit SF. An effective range is a theoretical range wherein the original sound decided by the scale factor and the quantization bit rate exists for the coefficient I(m). Here, assuming that the effective range of the coefficient I(m) is P(m), the quantization bit rate is W and the scale factor is SF, the effective range P(m) is defined by the following expression (23).

$$I(m)-\frac{SF}{2^{w-1}}<P(m)\leqq I(m)+\frac{SF}{2^{w-1}} \tag{23}$$

Here, when I(m)=SF is satisfied, the effective range P(m) is defined by the expression (24).

$$I(m)-\frac{SF}{2^{w-1}}<P(m)\leqq I(m) \tag{24}$$

When I(m)=−SF is satisfied, the effective range P(m) is defined by the expression (25).

$$I(m)<P(m)\leqq I(m)+\frac{SF}{2^{w-1}} \tag{25}$$

The definition of the effective ranges is absolutely an example, and the present invention is not limited to this as long as decision is made based on the quantization bit rate and the scale factor for a coefficient, such as definition of an effective range P(m) using the absolute value of a coefficient I(m).

In FIG. 8, each triangle indicates an interpolation coefficient S(m) computed by the computing circuit 14 in FIG. 7. Focusing attention on S(1), S(3) and S(4), it can be understood that an interpolation coefficient which is closer to the original sound is computed and said interpolation coefficient exists in the effective range indicated by the arrow. Regarding the interpolation coefficient S(2), however, an error due to Runge's phenomenon or the like of an interpolation method occurs by selecting a coefficient of an improper nodal point and it can be understood that the interpolation coefficient is out of the effective range which is theoretically possible. The correcting circuit 16 in FIG. 7 corrects said error based on the interpolation coefficient S(m) and the effective range P(m) outputted from the effective range deciding circuit 15.

When determining that an interpolation coefficient exists in an effective range, the correcting circuit 16 outputs the interpolation coefficient to the frequency-time transforming circuit 24 without correcting the same. On the other hand, when determining that an interpolation coefficient does not exist in the effective range, the correcting circuit 16 corrects the interpolation coefficient to be in the effective range. Said correction process is performed as described below, for example. When an interpolation coefficient is beyond an upper limit of an effective range defined by the expressions (23) to (25), for example, the interpolation coefficient is corrected to be the upper limit. In the meantime, when an interpolation coefficient is below a lower limit defined by the expressions (23) to (25), the interpolation coefficient is corrected to be the lower limit.

In addition, the interpolation coefficient may be multiplied by a predetermined gain g. Said gain g is the ratio of the interpolation coefficient S(m) to the upper limit (or lower limit) of the effective range P(m). Other interpolation coefficients (for example, contiguous S(m−2), S(m−1), S(m+1) and S(m+2)) are multiplied by said gain g and whether other interpolation coefficients are within the respective effective ranges (P(m−2), P(m−1), P(m+1) and P(m+2)) or not is determined. When determining that the interpolation coefficients are within the effective ranges, the correcting circuit 16 multiplies the interpolation coefficient S(m) by said gain g and outputs the value to the frequency-time transforming circuit 24.

On the other hand, when determining that other interpolation coefficients are not within the respective effective ranges, the correcting circuit 16 changes the value of the gain g by a predetermined value (e.g., 1.5g, 1.4g, 1.3g, . . . , 0.5g) and repeatedly changes the value until other interpolation coefficients come within the respective effective ranges. When other interpolation coefficients do not come within the respective effective ranges even after the above process is performed, only said interpolation coefficient S(m) is corrected to be the upper limit (or lower limit) as described above. In such a manner, it becomes possible to correct an interpolation coefficient to come within a theoretically possible range of quantization of the original sound and stabilize the signal process at the time of decoding even when an interpolation error occurs due to some cause. It should be noted that the correction process described above is absolutely an example and the process may be performed in other forms as long as an interpolation coefficient is corrected to come within an effective range.

Figure 9:
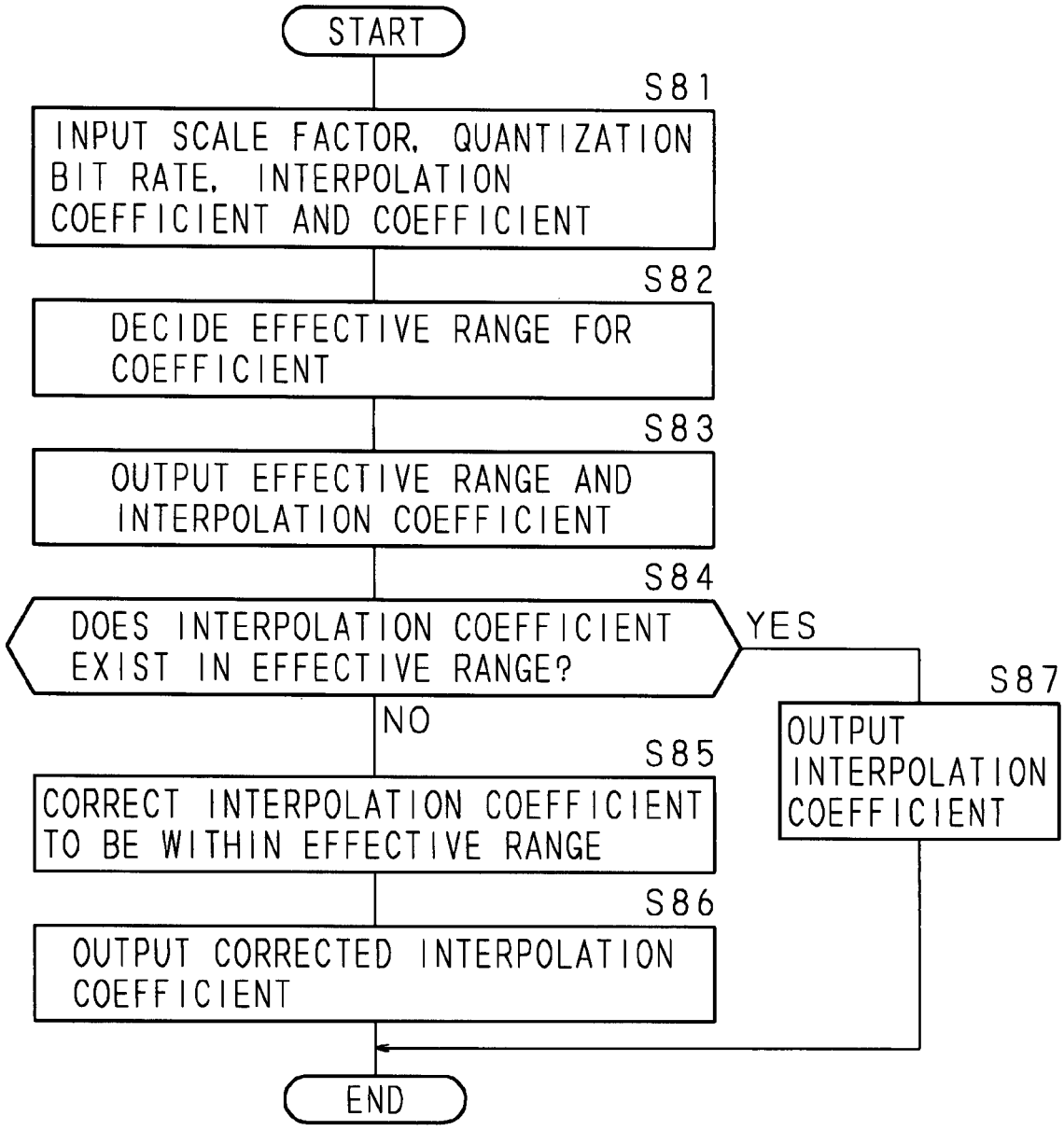
FIG. 9 is a flow chart showing the procedure of a correction process.

FIG. 9 is a flow chart showing the procedure of a correction process. Inputted into the effective range deciding circuit 15 are the scale factor, the quantization bit rate, the interpolation coefficient and the coefficient (step S81). The effective range deciding circuit 15 decides an effective range for a coefficient based on the inputted scale factor and quantization bit rate and the expressions (23) to (25) (step S82). The effective range deciding circuit 15 outputs the decided effective range for a coefficient and the interpolation coefficient to the correcting circuit 16 (step S83).

The correcting circuit 16 compares the interpolation coefficient with the effective range and determines whether the interpolation coefficient exists in the effective range or not (step S84). When determining that the interpolation coefficient exists in the effective range (YES in the step S84), the correcting circuit 16 outputs said interpolation coefficient to the frequency-time transforming circuit 24 without correcting the same (step S87). On the other hand, when determining that the interpolation coefficient does not exist in the effective range (NO in the step S84), the correcting circuit 16 corrects the interpolation coefficient to come within the effective range (step S85). When the interpolation coefficient is beyond the upper limit of the effective range defined by the expressions (23) to (25), the correcting circuit 16 corrects the interpolation coefficient to be the upper limit. In the meantime, when the interpolation coefficient is below the lower limit defined by the expressions (23) to (25), the correcting circuit 16 corrects the interpolation coefficient to be the lower limit. The correcting circuit 16 then outputs the corrected interpolation coefficient to the frequency-time transforming circuit 24 (step S86).

Figure 10:
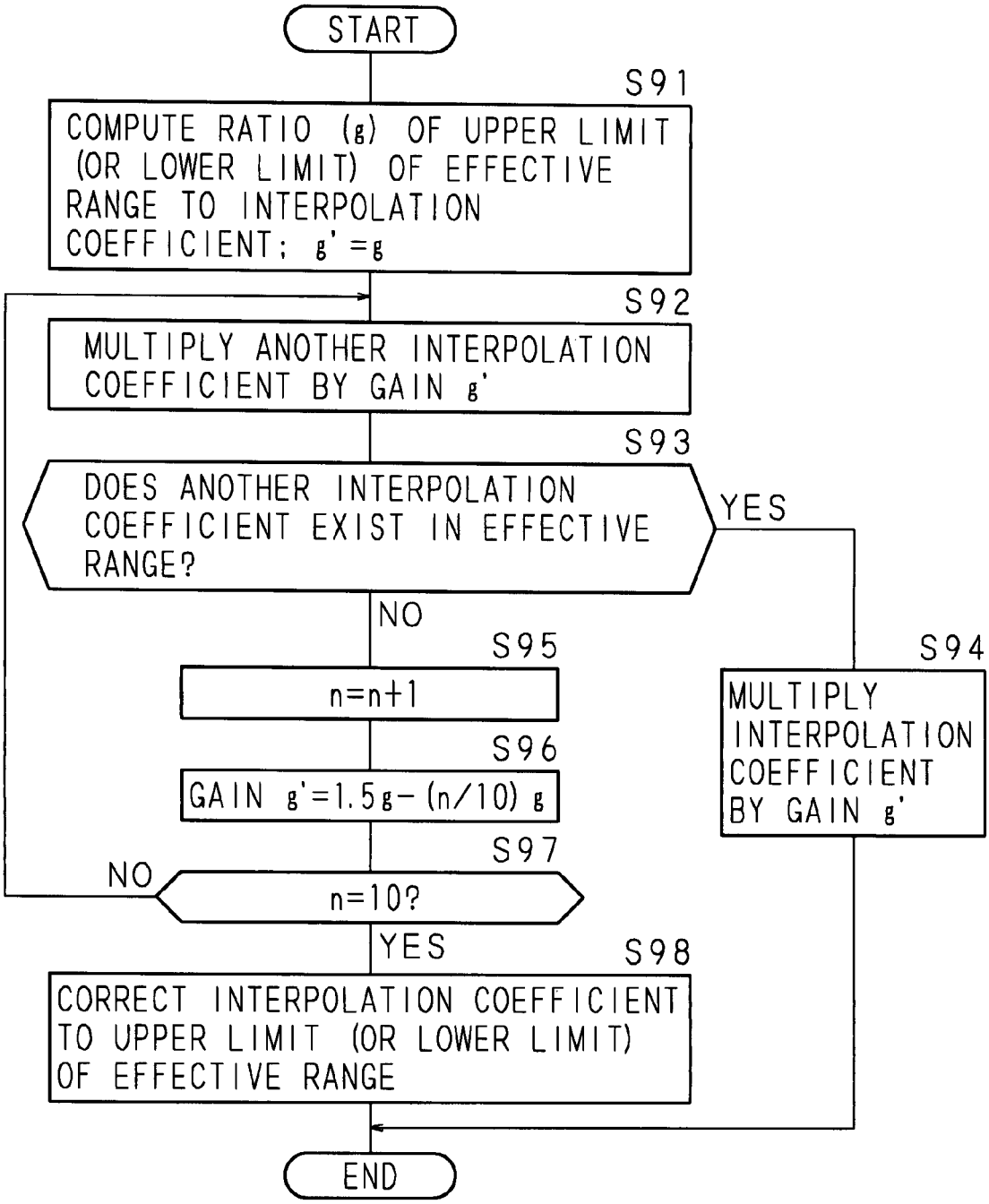
FIG. 10 is a flow chart showing the procedure of a computation process of a gain.

FIG. 10 is a flow chart showing the procedure of a computation process of a gain g. The process at the step S85 may be performed by computing the gain g as described above and multiplying an interpolation coefficient by said gain g. The correcting circuit 16 computes the ratio (g) of the upper limit (or lower limit) of the effective range outputted from the effective range deciding circuit 15 to the interpolation coefficient (step S91) and sets the result as a gain g. It should be noted that the correcting circuit 16 assigns the computed g to an initial value g' of a gain. The correcting circuit 16 multiplies other interpolation coefficients by the gain g' (step S92). This may be performed for interpolation coefficients in a frequency band which have the same quantization bit rate as a target interpolation coefficient S(m), for example.

The correcting circuit 16 determines whether other interpolation coefficients multiplied by the gain g' exist in effective ranges according to said other interpolation coefficients or not (step S93). When determining that all other interpolation coefficients multiplied by the gain g' exist in effective ranges according to the respective interpolation coefficients (YES in the step S93), the correcting circuit 16 multiplies an interpolation coefficient S(m) by said gain g' (step S94) and terminates the process. On the other hand, when determining that at least one of other interpolation coefficients multiplied by the gain g' does not exist in an effective range according to said other interpolation coefficient (NO in the step S93), the correcting circuit 16 performs the following process so as to change the gain g' in stages.

The correcting circuit 16 assigns n+1 to a variable n (step S95). It should be noted that the initial value of n is 0. The correcting circuit 16 subtracts (n/10)g from a value which is 1.5 times a gain g (gain of initial value g') so as to compute a new gain g' (step S96). That is, performed is a process for changing the gain g in stages of 10% within a range of ±50%. The range of the gain may be narrowed and the resolution of stages may be enhanced by subtracting (n/10)g from a value which is 1.5 times the gain g and subtracting (n/10)g from a value which is 1.25 times the gain g as the quantization bit rate increases from 2 to 3. The correcting circuit 16 determines whether the variable n is 10 or not (step S97). When determining that the variable n is not 10 (NO in the step S97), the correcting circuit 16 proceeds to the step S92 and multiplies another interpolation coefficient by a new gain g'. As described above, a process for incrementing the variable n so as to change the gain g in stages is repeatedly performed.

When determining that n is 10 (YES in the step S97), that is, when the gain g is equal to or larger than 1.5g or equal to or smaller than 0.5g, the correcting circuit 16 determines that correction using the gain g is difficult and corrects an interpolation coefficient to the upper limit (or lower limit) of the effective range (step S98). It should be noted that, though a process for multiplying g by 1.5 is performed in the step S96 in the present embodiment, this is absolutely an example and any suitable value may be used for multiplication.

Since the present Embodiment 2 has such a structure and other structures and functions are the same as those of Embodiment 1, like codes are used to refer to like parts and detailed explanation thereof will be omitted.

Embodiment 3

Figure 11:
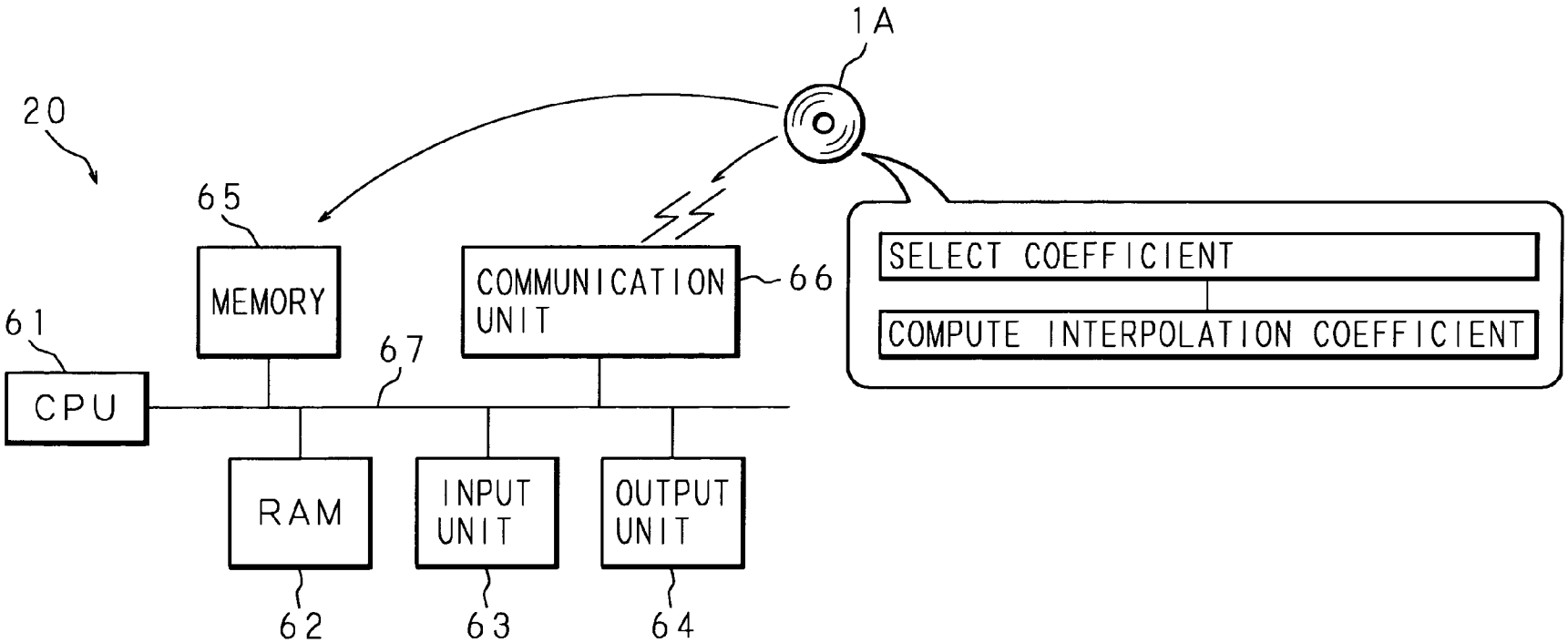
FIG. 11 is a block diagram showing the structure of a signal processing apparatus according to Embodiment 3.

FIG. 11 is a block diagram showing the structure of a signal processing apparatus 20 according to Embodiment 3. Each process of the decoding apparatus (signal processing apparatus) 20 according to Embodiment 1 may be realized by software executed by a personal computer. The following description will explain an example wherein the signal processing apparatus 20 is a personal computer 20. The personal computer 20 is a known computer comprising: a CPU (Central Processing Unit) 61; and a RAM (Random Access Memory) 62, a memory 65 such as a hard disk, an input unit 63, an output unit 64 such as a speaker and a communication unit 66, which can be connected with a communication network such as the Internet, that are connected with the CPU 61 via a bus 67.

A computer program for causing the personal computer 20 to operate can be provided in the form of a portable recording medium 1A such as a CD-ROM, an MO or a DVD-ROM as in the present Embodiment 3. Furthermore, it is also possible to download the computer program from a server computer, which is not illustrated, via the communication unit 66. The following description will explain the content thereof.

The portable recording medium 1A (CD-ROM, MO, DVD-ROM or the like) which records therein a computer program for causing a reader/writer, that is not illustrated, in the personal computer 20 shown in FIG. 11 to select a coefficient and compute an interpolation coefficient is inserted to install said program into a control program in the memory 65. Instead, such a program may be downloaded from an external server computer, which is not illustrated, via the communication unit 66 and installed into the memory 65. Such a program is loaded into the RAM 62 for execution. In this manner, the personal computer functions as a signal processing apparatus 20 according to the present invention as described above.

Since the present Embodiment 3 has such a structure and other structures and functions are the same as those of Embodiments 1 and 2, like codes are used to refer to like parts and detailed explanation thereof will be omitted.

Embodiment 4

Figure 12:
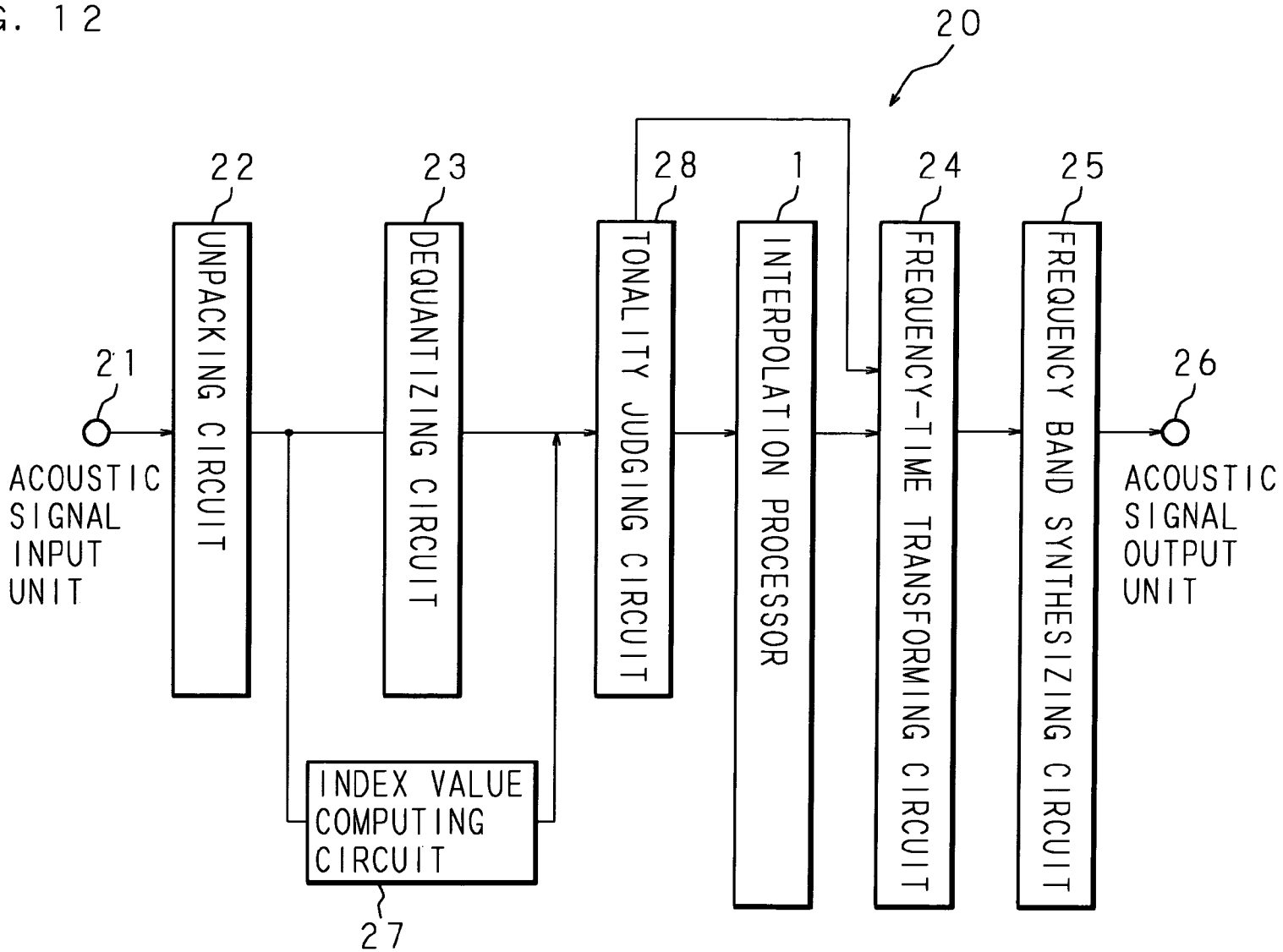
FIG. 12 is a block diagram showing the hardware structure of a decoding apparatus according to Embodiment 4.

Embodiment 4 relates to a form for determining whether a coefficient is to be interpolated or not depending on the tonality of an acoustic signal. FIG. 12 is a block diagram showing the hardware structure of a decoding apparatus 20 according to Embodiment 4. As shown in FIG. 12, an index value computing circuit 27 and a tonality judging circuit 28 are newly provided. The unpacking circuit 22 extracts a scale factor for each frequency band from frame side information of a bit stream. The extracted scale factor is outputted to the index value computing circuit 27.

The index value computing circuit 27 computes a tonality index value indicative of the degree of tonality by subtracting a mean value from the maximum value of a scale factor of each frequency band. The computed tonality index value is outputted to the tonality judging circuit 28. A reference value is stored in a memory, which is not illustrated, in the tonality judging circuit 28, and the tonality judging circuit 28 compares the inputted tonality index value with the reference value so as to determine whether the tone is a pure tone or not. It should be noted that said reference value may be 70 dB when the maximum value of the scale factor is 120 dB, for example.

When the tonality index value is smaller than the reference value, the tonality judging circuit 28 determines that the tonality is low and outputs coefficients I(m) of all the frequency bands to the interpolation processor 1 so as to perform the interpolation process described above. On the other hand, when the tonality index value is larger than the reference value, the tonality judging circuit 28 determines that the tonality is high and outputs the coefficients I(m) of all the frequency bands directly to the frequency-time transforming circuit 24 without outputting the same to the interpolation processor 1. By executing or not executing an interpolation process depending on the characteristic of an acoustic signal as described above, a suitable interpolation process can be achieved and it becomes possible to speed up processing and reduce the power consumption.

Figure 13:
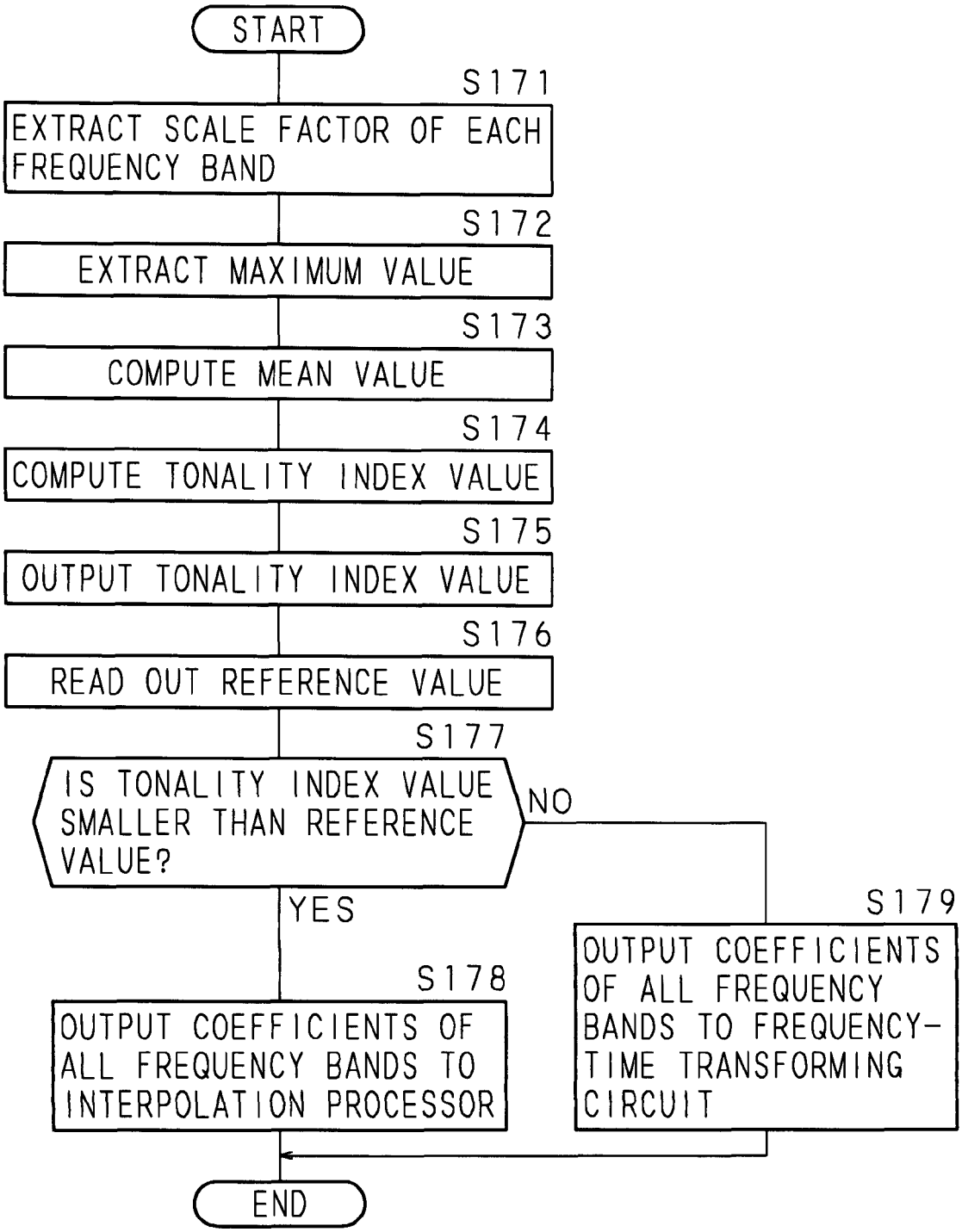
FIG. 13 is a flow chart showing the procedure of a tonality judging process.

FIG. 13 is a flow chart showing the procedure of a tonality judging process. The unpacking circuit 22 extracts a scale factor of each frequency band from frame side information of a bit stream (step S171). The extracted scale factor is outputted to the index value computing circuit 27. The index value computing circuit 27 extracts the maximum value from a scale factor of each frequency band (step S172). The index value computing circuit 27 also computes the mean value of the scale factor (step S173). The index value computing circuit 27 subtracts the mean value from the maximum value of the scale factor so as to compute a tonality index value (step S174). The index value computing circuit 27 outputs the computed tonality index value to the tonality judging circuit 28 (step S175).

The tonality judging circuit 28 reads out a reference value from a memory, which is not illustrated, provided therein (step S176). The tonality judging circuit 28 then compares the inputted tonality index value with the reference value and determines whether the tonality index value is smaller than the read-out reference value or not (step S177). When determining that the tonality index value is smaller than the reference value (YES in the step S177), the tonality judging circuit 28 determines that the tonality is low and outputs the coefficients I(m) of all the frequency bands to the interpolation processor 1 (step S178).

On the other hand, when determining that the tonality index value is larger than the reference value (NO in the step S177), the tonality judging circuit 28 determines that the tonality is high and outputs the coefficients I(m) of all the frequency bands directly to the frequency-time transforming circuit 24 without outputting the same to the interpolation processor 1 (step S179). It should be noted that whether the tone is a pure tone or not may be determined based on power of each frequency band, though whether the tone is a pure tone or not is determined in the present Embodiment 4 based on the scale factor. In this case, the index value computing circuit 27 subtracts the mean value from the maximum value of power of coefficients I(m) of each frequency band and outputs the result as a tonality index value to the tonality judging circuit 28. In the tonality judging circuit 28, 40 dB is prestored as the reference value, for example. When the tonality index value is smaller than said reference value, the tonality judging circuit 28 determines that the tonality is low and outputs the coefficients I(m) of all the frequency bands to the interpolation processor 1. On the other hand, when the tonality index value is larger than the reference value, the tonality judging circuit 28 determines that the tonality is high and outputs the coefficients I(m) of all the frequency bands to the frequency-time transforming circuit 24 without sending the same through the interpolation processor 1. It should be noted that a technique disclosed in Japanese Patent Application Laid-Open No. 2002-351500 or Japanese Patent Application Laid-Open No. 2005-195983 may be applied to the determination of tonality described above.

Since the present Embodiment 4 has such a structure and other structures and functions are the same as those of Embodiments 1 to 3, like codes are used to refer to like parts and detailed explanation thereof will be omitted.

Embodiment 5

Figure 14:
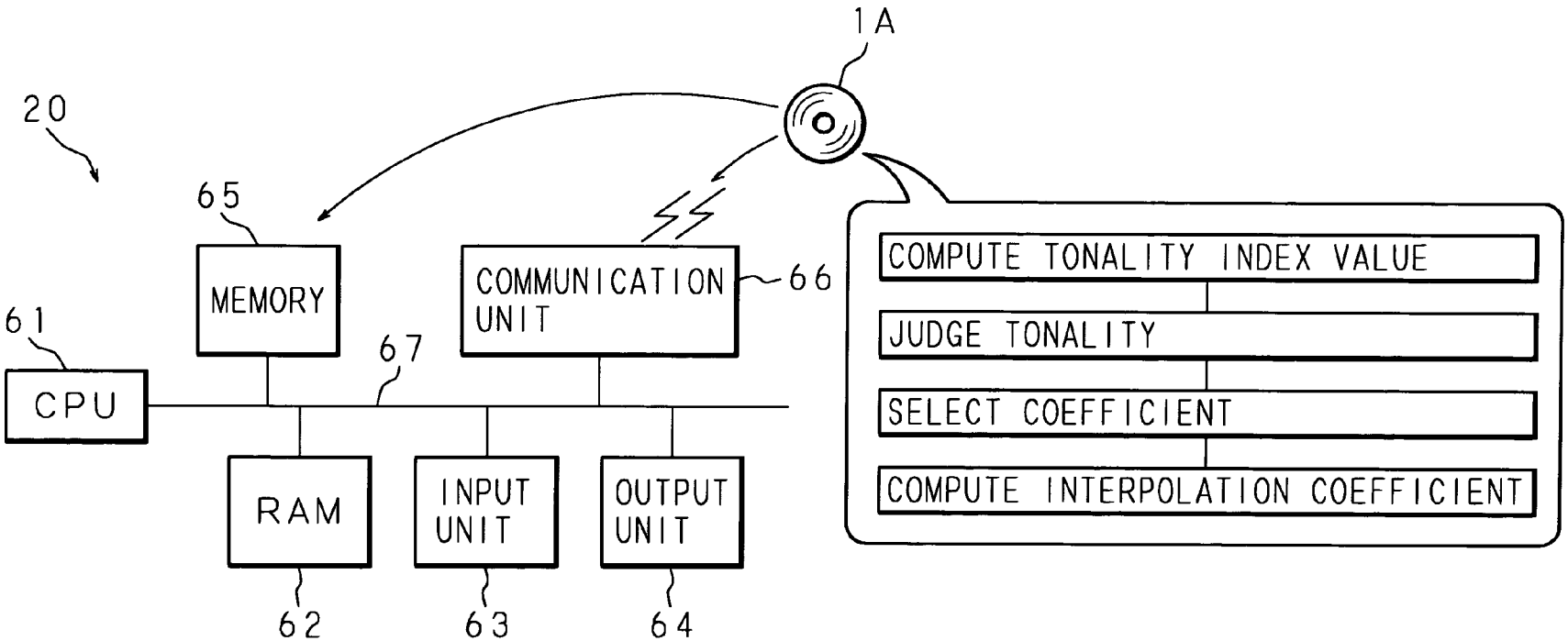
FIG. 14 is a block diagram showing the structure of a signal processing apparatus according to Embodiment 5.

The process according to Embodiment 4 may be realized as a software process using a personal computer shown in FIG. 11. FIG. 14 is a block diagram showing the structure of a signal processing apparatus 20 according to Embodiment 5. A computer program for causing the personal computer 20, which is a signal processing apparatus, to operate can be provided in the form of a portable recording medium 1A such as a CD-ROM, an MO or a DVD-ROM as in the present Embodiment 5. Furthermore, it is also possible to download the computer program from a server computer, which is not illustrated, via the communication unit 66. The following description will explain the content thereof.

The portable recording medium 1A (CD-ROM, MO, DVD-ROM or the like), which records therein a computer program for causing a reader/writer, that is not illustrated, in the personal computer 20 shown in FIG. 14 to compute a tonality index value, determine whether the tonality is high or not, select a coefficient and compute an interpolation coefficient depending on whether the tonality is high or not, is inserted to install said program into a control program in the memory 65. Instead, such a program may be downloaded from an external server computer, which is not illustrated, via the communication unit 66 and installed into the memory 65. Such a program is loaded into the RAM 62 for execution. In this manner, the personal computer functions as a signal processing apparatus 20 according to the present invention as described above.

Since the present Embodiment 5 has such a structure and other structures and functions are the same as those of Embodiments 1 to 4, like codes are used to refer to like parts and detailed explanation thereof will be omitted.

Embodiment 6

Figure 15:
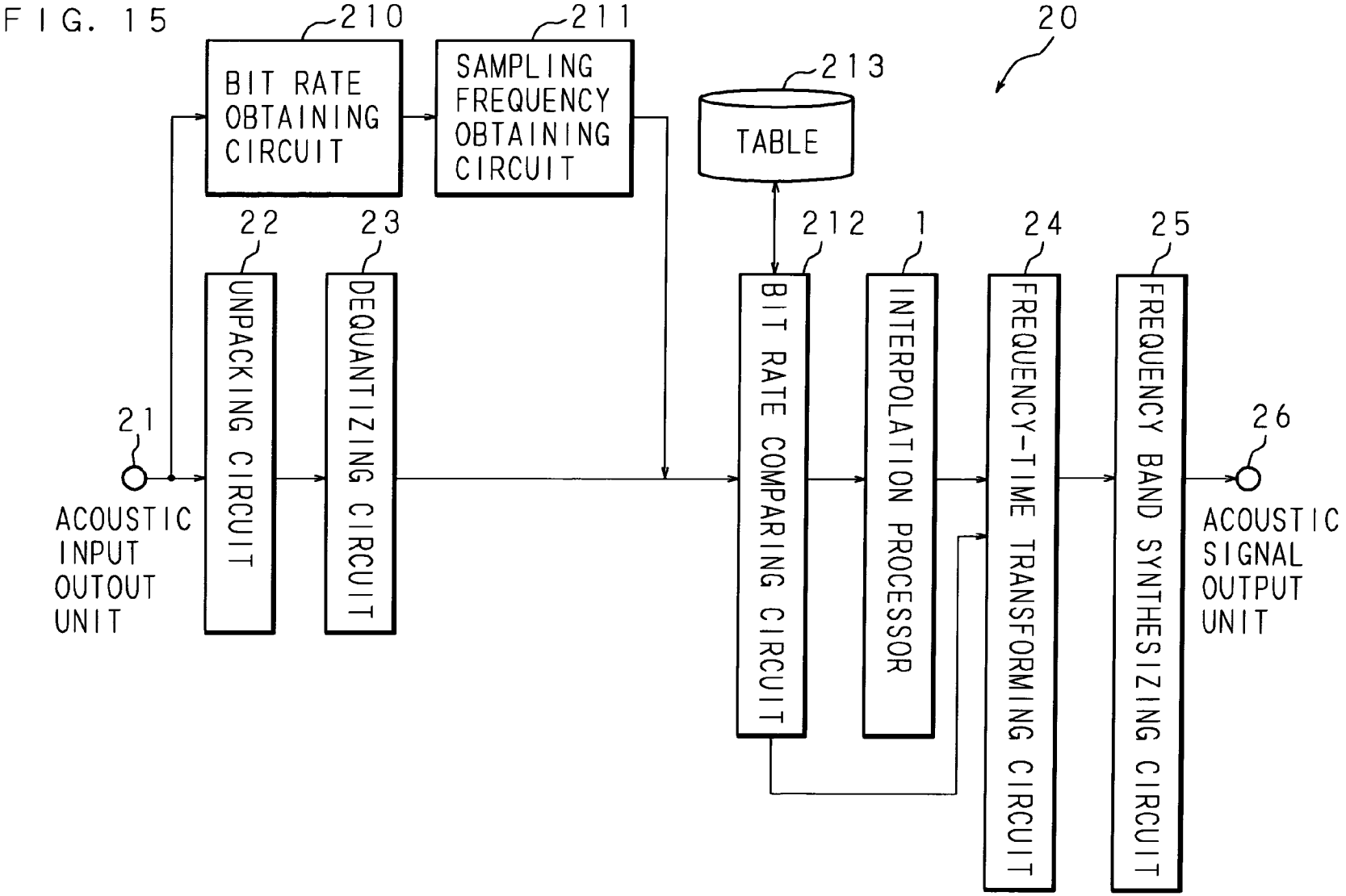
FIG. 15 is a block diagram showing the hardware structure of a decoding apparatus according to Embodiment 6.

Embodiment 6 relates to a form for determining whether an interpolation process is to be executed or not depending on a bit rate. FIG. 15 is a block diagram showing the hardware structure of a decoding apparatus 20 according to Embodiment 6. As shown in FIG. 15, a bit rate obtaining circuit 210, a sampling frequency obtaining circuit 211, a bit rate comparing circuit 212 and a table 213 are newly provided. The bit rate obtaining circuit 210 obtains a bit rate of an acoustic signal from a bit rate index described in a header attached to an acoustic signal. The obtained bit rate is outputted to the bit rate comparing circuit 212 via the sampling frequency obtaining circuit 211.

The sampling frequency obtaining circuit 211 obtains a sampling frequency described in a header attached to an acoustic signal. In the MP3 method, any one of 32 kHz, 44.1 kHz and 48 kHz is obtained as a sampling frequency. The sampling frequency obtaining circuit 211 outputs the obtained sampling frequency to the bit rate comparing circuit 212.

FIG. 16 is an explanatory view showing the record layout of the table 213. Stored in the table 213 is a reference bit rate which is a reference for each sampling frequency. In the table 213, a bit rate is stored for each of sampling frequencies of 32 kHz, 44.1 kHz and 48 kHz. For 32 kHz, 160 kbps is stored as the reference bit rate so that determination of tonality and an interpolation process described above are performed when the bit rate is smaller than 160 kbps as shown in FIG. 16 by hatching.

Moreover, for 44.1 kHz, 192 kbps is stored as the reference bit rate so that determination of tonality and an interpolation process described above are performed when the bit rate is smaller than 192 kbps as shown in FIG. 16 by hatching. Furthermore, for 48 kHz, 224 kbps is stored as the reference bit rate so that determination of tonality and an interpolation process described above are performed when the bit rate is smaller than 224 kbps as shown in FIG. 16 by hatching. It should be noted that the sampling frequency for a minidisk of ATRAC3 specification is only 44.1 kHz and the reference bit rate is 292 kbps in this case so that determination of tonality and an interpolation process described above are performed when the bit rate is 132 kbps, 105 kbps or 66 kbps, which is smaller than 292 kbps.

The bit rate comparing circuit 212 reads out a reference bit rate from the table 213 based on the sampling frequency outputted from the sampling frequency obtaining circuit 211. The bit rate comparing circuit 212 then determines whether the bit rate outputted from the bit rate obtaining circuit 210 is smaller than the reference bit rate or not. When determining that the bit rate outputted from the bit rate obtaining circuit 210 is smaller than the reference bit rate, the bit rate comparing circuit 212 outputs coefficients I(m) of all the frequency bands to the interpolation processor 1. For example, when the obtained sampling frequency is 32 kHz and the obtained bit rate is 32 kbps, 64 kbps, 96 kbps or 128 kbps, the coefficients I(m) of all the frequency bands become subject to an interpolation process.

On the other hand, when determining that the bit rate outputted from the bit rate obtaining circuit 210 is not smaller than the reference bit rate, the bit rate comparing circuit 212 outputs coefficients I(m) of all the frequency bands directly to the frequency-time transforming circuit 24 without sending the same through the interpolation processor 1. For example, when the obtained sampling frequency is 32 kHz and the obtained bit rate is 160 kbps, 192 kbps, 224 kbps, 256 kbps, 288 kbps, 320 kbps, 352 kbps, 384 kbps, 416 kbps or 448 kbps, coefficients I(m) of each frequency band do not become subject to an interpolation process. Since the present invention is constructed to execute or not to execute an interpolation process depending on the sampling frequency and the bit rate as described above, the most suitable interpolation process matching the state of the acoustic signal can be achieved and it becomes possible to speed up processing and reduce the power consumption.

Figure 17:
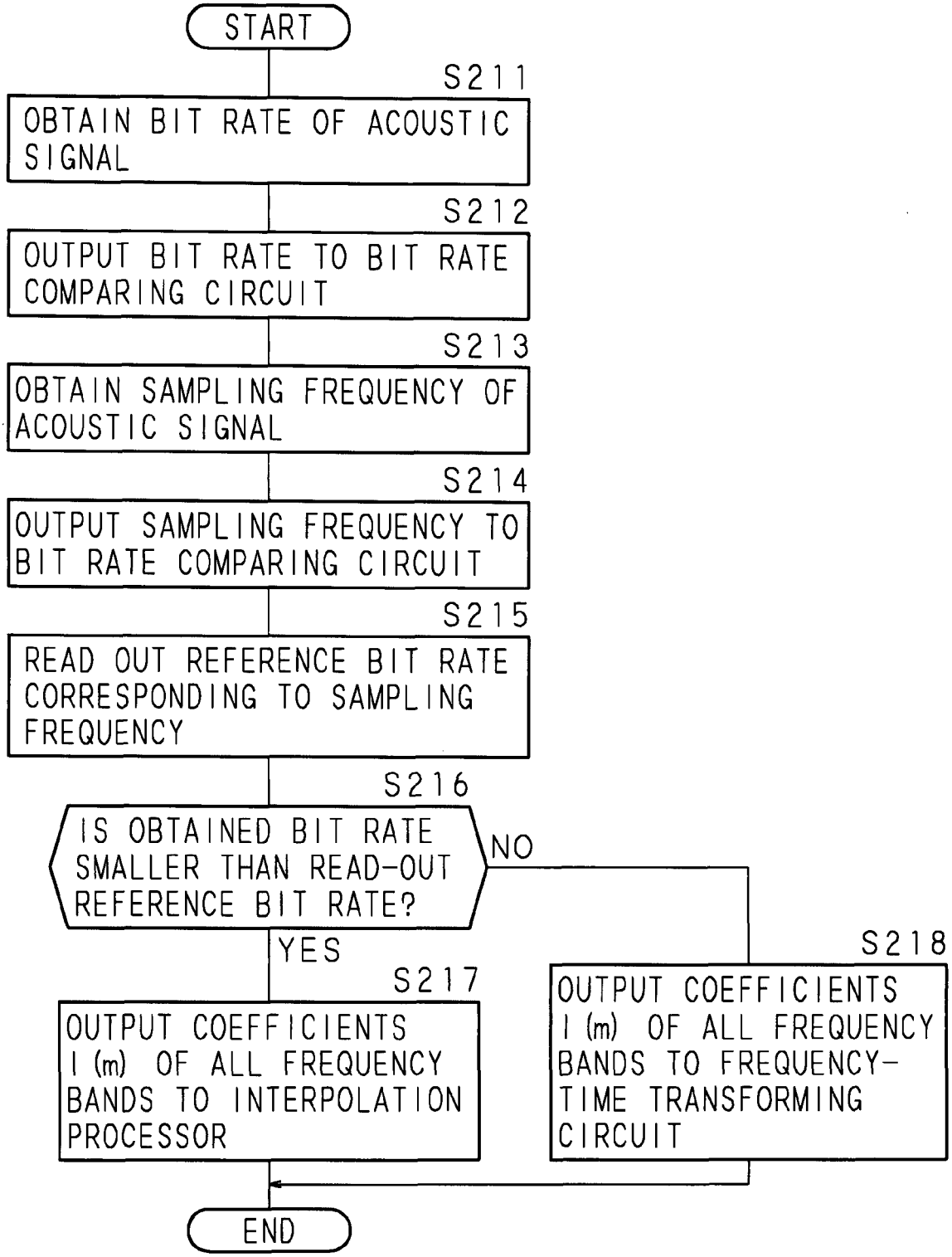
FIG. 17 is a flow chart showing the procedure of a comparison process.

FIG. 17 is a flow chart showing the procedure of a comparison process. The bit rate obtaining circuit 210 obtains a bit rate of an acoustic signal from a bit rate index described in a header attached to an acoustic signal (step S211). The bit rate obtaining circuit 210 outputs the obtained bit rate to the bit rate comparing circuit 212 via the sampling frequency obtaining circuit 211 (step S212). The sampling frequency obtaining circuit 211 obtains a sampling frequency described in a header attached to an acoustic signal (step S213). The sampling frequency obtaining circuit 211 outputs the obtained sampling frequency to the bit rate comparing circuit 212 (step S214).

The bit rate comparing circuit 212 reads out, from the table 213, a reference bit rate corresponding to the sampling frequency outputted from the sampling frequency obtaining circuit 211 (step S215). The bit rate comparing circuit 212 then determines whether the bit rate obtained by the bit rate obtaining circuit 210 is smaller than the read-out reference bit rate or not (step S216). When determining that the obtained bit rate is smaller than the reference bit rate (YES in the step S216), the bit rate obtaining circuit 210 outputs coefficients I(m) of all the frequency bands to the interpolation processor 1 (step S217).

On the other hand, when determining that the obtained bit rate is not smaller than the reference bit rate (NO in the step S216), the bit rate obtaining circuit 210 outputs coefficients I(m) of all the frequency bands directly to the frequency-time transforming circuit 24 without sending the same through the interpolation processor 1 (step S218).

Since the present Embodiment 6 has such a structure and other structures and functions are the same as those of Embodiments 1 to 5, like codes are used to refer to like parts and detailed explanation thereof will be omitted.

Embodiment 7

Figure 18:
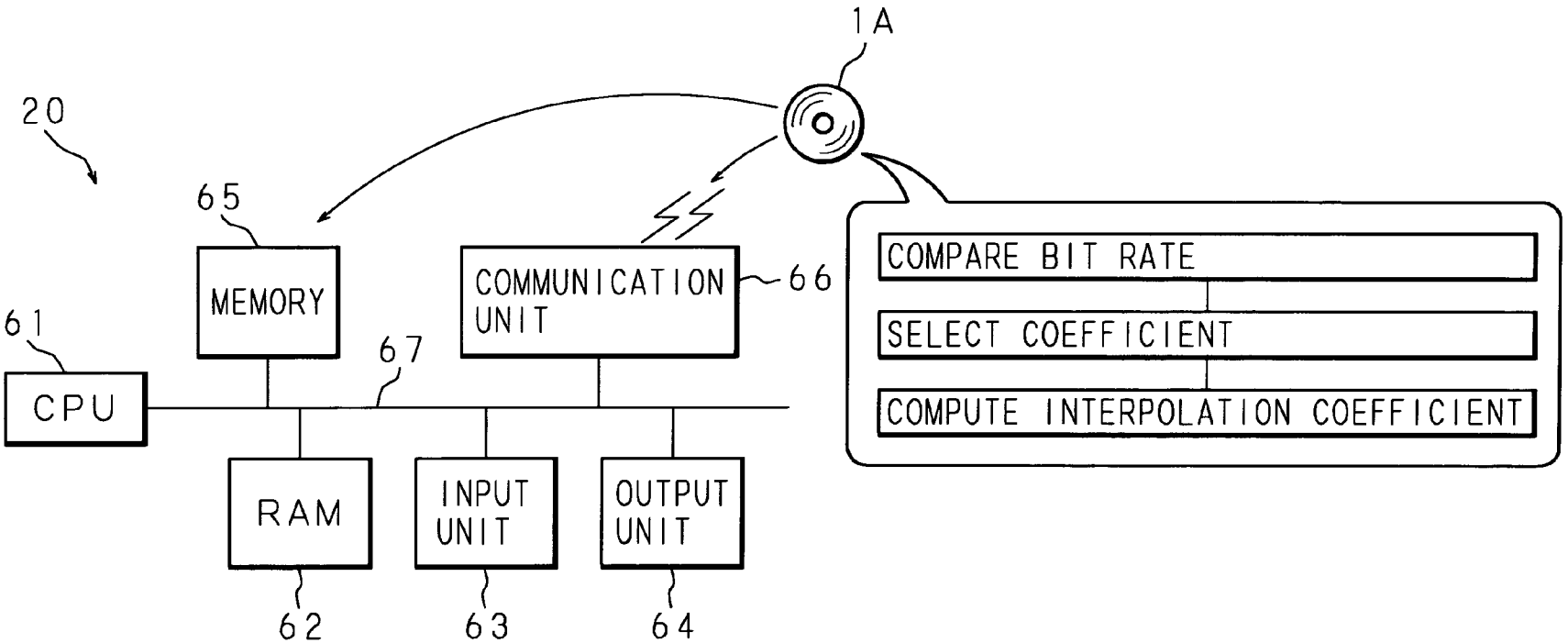
FIG. 18 is a block diagram showing the structure of a signal processing apparatus according to Embodiment 7.

The process according to Embodiment 6 may be realized as a software process using the personal computer shown in FIG. 11. FIG. 18 is a block diagram showing the structure of a signal processing apparatus 20 according to Embodiment 7. A computer program for causing the personal computer 20, which is a signal processing apparatus, to operate can be provided in the form of a portable recording medium 1A such as a CD-ROM, an MO or a DVD-ROM as in the present Embodiment 7. Furthermore, it is also possible to download the computer program from a server computer, which is not illustrated, via the communication unit 66. The following description will explain the content thereof.

The portable recording medium 1A (CD-ROM, MO, DVD-ROM or the like) which records therein a computer program for causing a reader/writer, that is not illustrated, in the personal computer 20 shown in FIG. 18 to compare bit rates, select a coefficient and compute an interpolation coefficient depending on the bit rate is inserted to install said program into a control program in the memory 65. Instead, such a program may be downloaded from an external server computer, which is not illustrated, via the communication unit 66 and installed into the memory 65. Such a program is loaded into the RAM 62 for execution. In this manner, the personal computer functions as a signal processing apparatus 20 according to the present invention as described above.

Since the present Embodiment 7 has such a structure and other structures and functions are the same as those of Embodiments 1 to 6, like codes are used to refer to like parts and detailed explanation thereof will be omitted.

Embodiment 8

Figure 19:
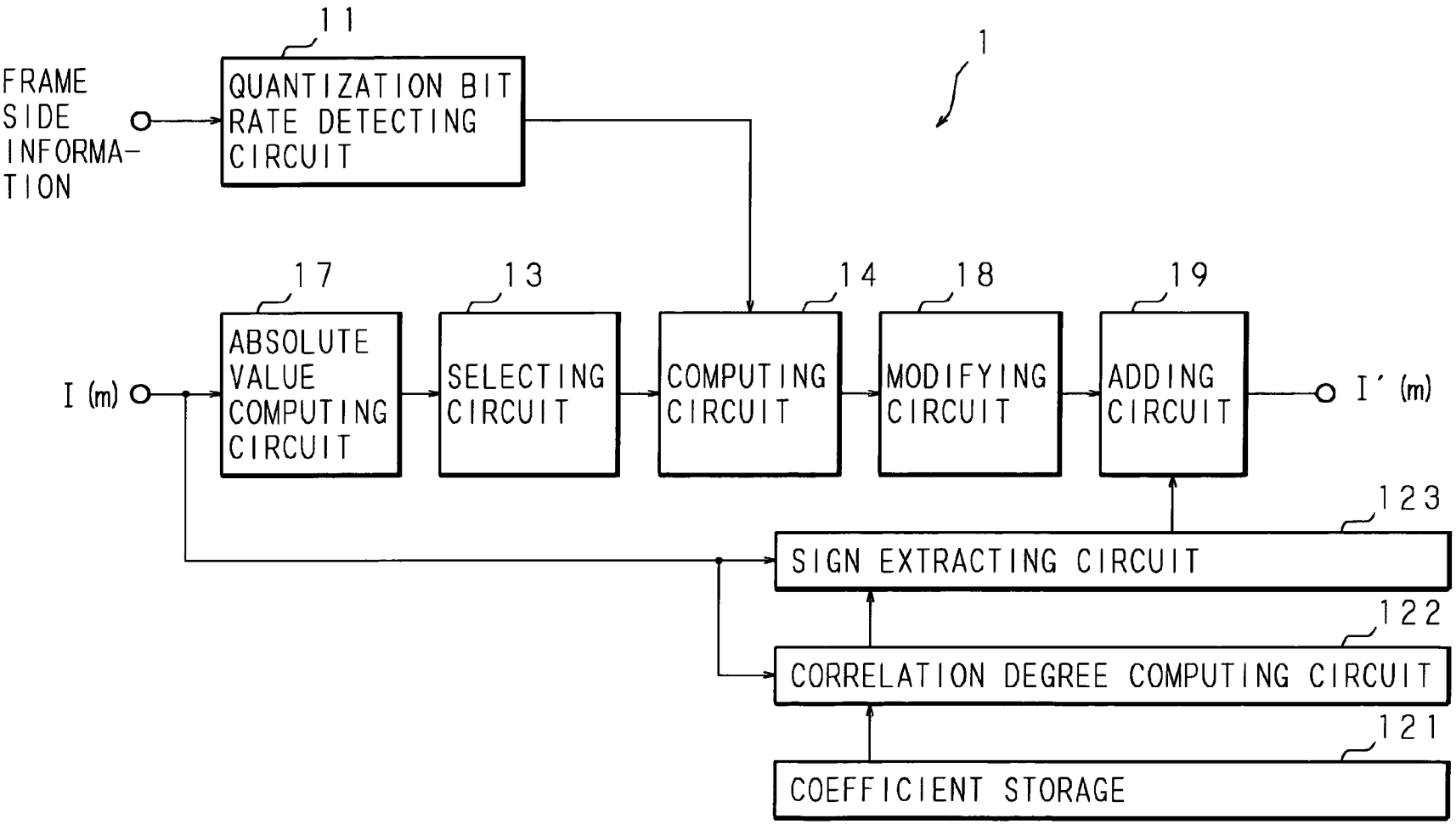
FIG. 19 is a block diagram showing the hardware structure of an interpolation processor according to Embodiment 8.

FIG. 19 is a block diagram showing the hardware structure of an interpolation processor 1 according to Embodiment 8. The interpolation processor 1 comprises a quantization bit rate detecting circuit 11, an absolute value computing circuit 17, a selecting circuit 13, a computing circuit 14, a modifying circuit 18, an adding circuit 19, a sign extracting circuit 123, a correlation degree computing circuit 122 and a coefficient storage 121. A coefficient of a dequantized frequency band is inputted into the absolute value computing circuit 17. The absolute value computing circuit 17 computes the absolute value of the inputted coefficient and outputs a coefficient of frequency bands all of which have positive values to the selecting circuit 13. The quantization bit rate detecting circuit 11 outputs the quantization bit rate of a coefficient of a frequency band to the computing circuit 14. It should be noted that the interpolation process at the selecting circuit 13 and the computing circuit 14 is the same as that described above and detailed explanation thereof will be omitted.

An interpolation coefficient, which is obtained by interpolating a coefficient according to an absolute value by spline interpolation or the like, and a coefficient according to an absolute value, which is not interpolated, are outputted from the computing circuit 14 to the modifying circuit 18. The modifying circuit 18 determines whether the sign of an interpolation coefficient interpolated by the computing circuit 14 is positive or negative. When the sign of the interpolation coefficient is negative, the modifying circuit 18 then determines that an error due to Runge's phenomenon, overshoot or the like has occurred and modifies said interpolation coefficient to 0.

The modifying circuit 18 outputs the modified coefficient 0, an interpolation coefficient having a positive sign and a coefficient according to an absolute value which is not interpolated to the adding circuit 19. The adding circuit 19 adds a sign to an interpolation coefficient having a positive sign and a coefficient according to an absolute value which is not interpolated based on the output from the sign extracting circuit 123. An original coefficient I(m) to which an absolute value process is not applied is inputted into the sign extracting circuit 123 and the correlation degree computing circuit 122. The sign extracting circuit 123 extracts the sign of the coefficient I(m) and outputs the sign to the adding circuit 19. The adding circuit 19 adds a sign of the same zone outputted from the sign extracting circuit 123 to an interpolation coefficient having a positive sign and a coefficient which is not interpolated. In this manner, a sign changed by the absolute value computing circuit 17 is restored.

When the coefficient I(m) is 0, that is, when determining that the information of a sign of the coefficient I(m) is lost by a quantization error, the sign extracting circuit 123 requires output of a sign of the correlation degree computing circuit 122. When the coefficient I(m) is 0, the correlation degree computing circuit 122 refers to the coefficient storage 121 and decides the sign. FIG. 20 is an explanatory view showing the record layout of the coefficient storage 121. The coefficient storage 121 stores a number of existent sine MDCT coefficients before coding. As shown in FIG. 20, stored are MDCT coefficients M(m) (orthogonal transform coefficients) which are obtained by transforming sine waves having different phases for each of a number of frames by MDCT.

When a coefficient I(m) is 0, the correlation degree computing circuit 122 extracts adjacent coefficients, e.g., contiguous I(m−3), I(m−2), I(m−1), I(m+1), I(m+2) and I(m+3). The correlation degree computing circuit 122 then extracts a predetermined number of MDCT coefficients, e.g. M(m−3), M(m−2), M(m−1), M(m+1), M(m+2), M(m+3), from the coefficient storage 121 and computes the degree of correlation with contiguous coefficients I(m−3), I(m−2), I(m−1), I(m+1), I(m+2) and I(m+3). The correlation degree computing circuit 122 then changes m of an MDCT coefficient M(m) while reading out the sign of Mr(m) of MDCT coefficients Mr(m−3), Mr(m−2), Mr(m−1), Mr(m+1), Mr(m+2) and Mr(m+3) having the highest degree of correlation, i.e. having the largest correlation value based on a correlation function, and outputs the same to the sign extracting circuit 123. For example, when it is determined that a degree of correlation of M(2), M(3), M(4), M(6), M(7) and M(8) of a frame Fr002 is the highest, the sign "negative" of M(5)=−0.083181 at the center is extracted. It should be noted that the adjacent coefficients are not limited to three contiguous coefficients described above, and may be two contiguous coefficients, a plurality of every other contiguous coefficients, or the like.

Figure 21:
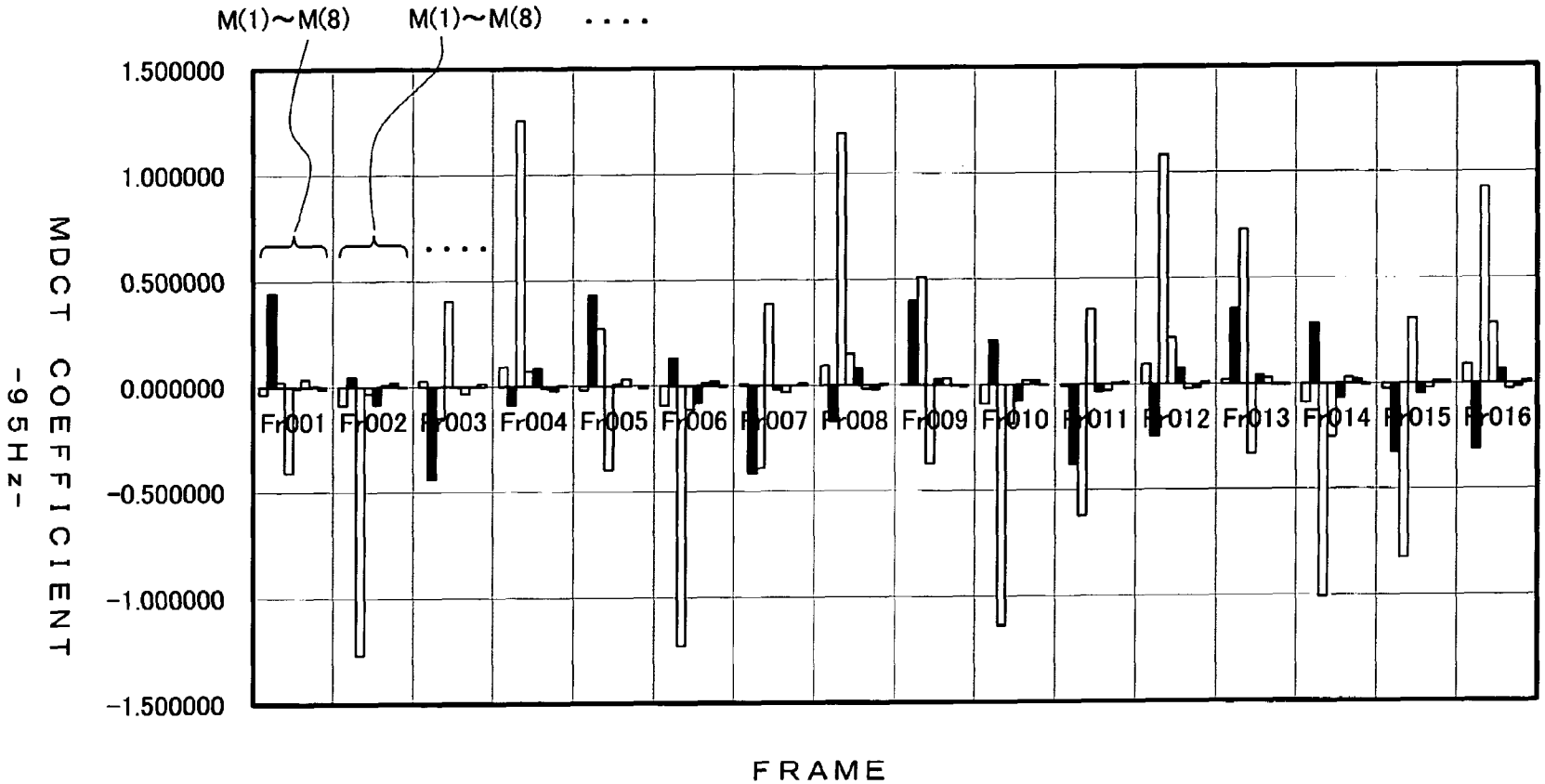
FIG. 21 is a graph showing an MDCT coefficient from 0 Hz to approximately 306 Hz, which is obtained by transforming a sine wave of 95 Hz before coding by an MDCT by a frame (granule) unit.
Figure 22:
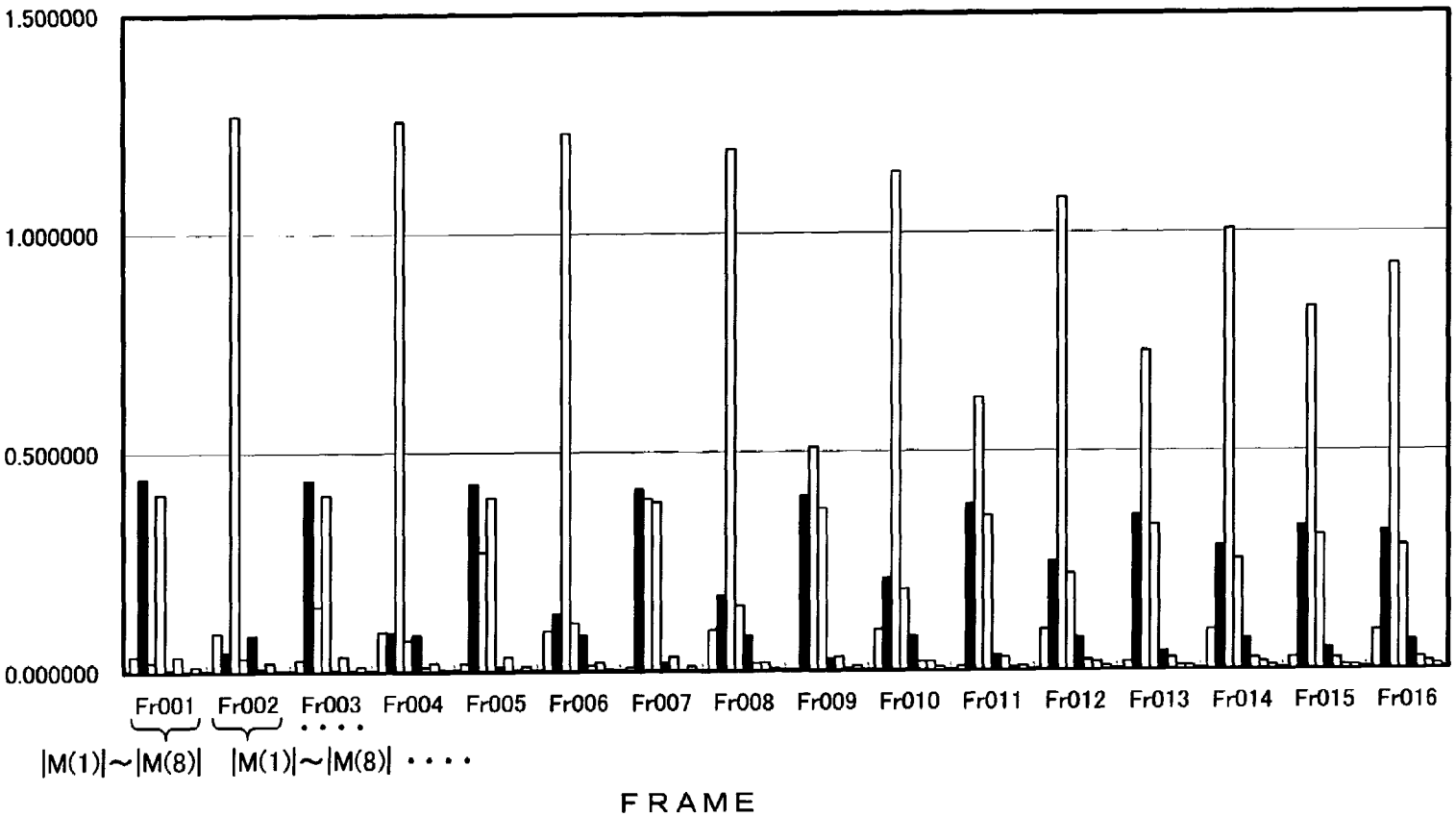
FIG. 22 is a graph showing an absolute value of a computed MDCT coefficient shown in FIG. 21.

The sign extracting circuit 123 outputs the extracted sign "negative" to the adding circuit 19. The adding circuit 19 adds the sign to an interpolation coefficient. The adding circuit 19 outputs all the coefficients, to which a sign is added as described above, to the frequency-time transforming circuit 24. Music is composed of a set of sine waves, and computation of a degree of correlation is performed under a narrow band (which uses six MDCT coefficients, for example), that is, under the premises that a spectrum strong enough to have an impact does not exist, so as to decide the most likely sign. Since the sign is decided in view of the regularity of a sine MDCT coefficient as described above, it also becomes possible to accurately reproduce the information of the sign lost by the quantization error. Here, the reason of computing and interpolating the absolute value of I(m) will be described. FIG. 21 is a graph showing an MDCT coefficient from 0 Hz to approximately 306 Hz, which is obtained by transforming a sine wave of 0 dB of 95 Hz before coding, by an MDCT by a frame (granule) unit. In FIG. 21, 1.0 and 0.5 on the ordinate axis respectively indicate 0 dB and approximately −3 dB (approximately −6 dB for a spectrum power). It should be noted that a coefficient value indicated in FIG. 20 is employed as data of the graph. M(m) is an MDCT coefficient (m is an integer from 1 to 8) having a resolution of approximately 38 Hz. FIG. 22 is a graph showing an absolute value of a computed MDCT coefficient shown in FIG. 21. As shown in FIG. 21, since it is the characteristic of an MDCT coefficient that the sum of the spectrum power is constant, it is easier to perform interpolation after computing the absolute value than to perform interpolation from an MDCT coefficient with sign using an interpolation function. In an interpolation coefficient, as described above, the interpolation accuracy of an interpolation process can be enhanced by computing the absolute value and performing an interpolation process based on a coefficient according to the absolute value.

Figure 23A:
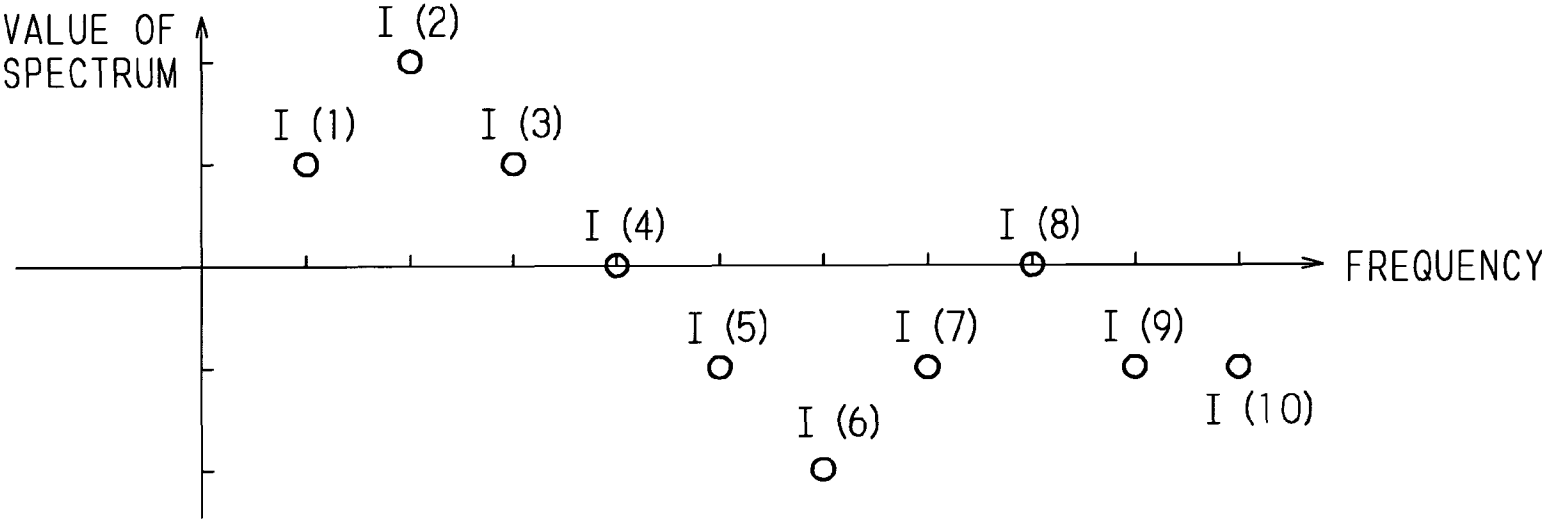
FIGS. 23A, 23B, 23C and 23D are graphs showing an image of a sign deciding process.
Figure 23B:
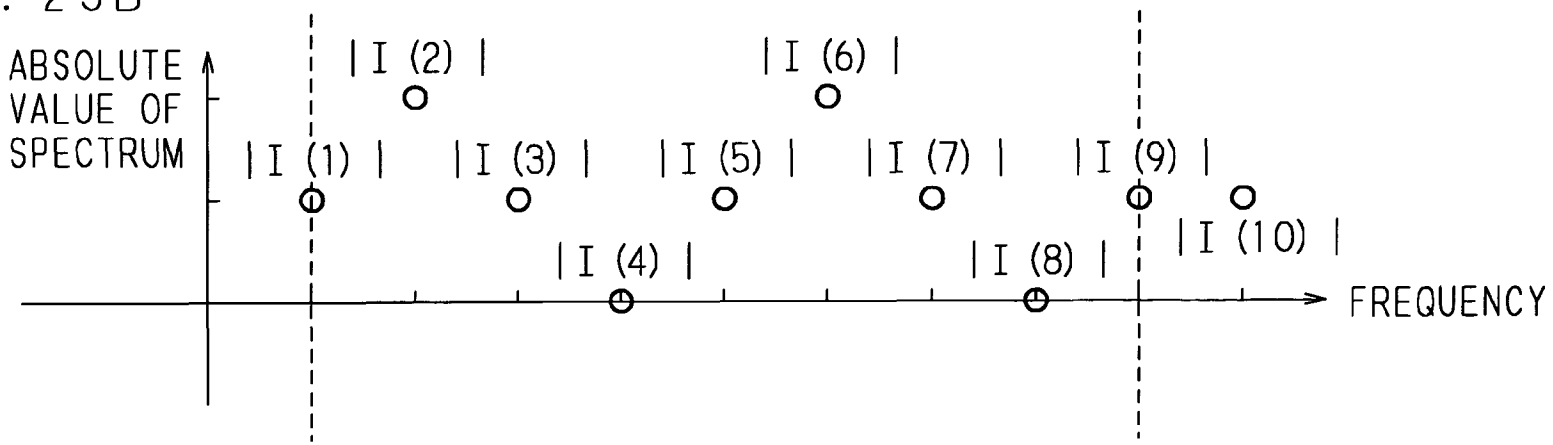

The following description will explain the sign deciding process described above using a specific example. FIGS. 23A, 23B, 23C and 23D are graphs showing an image of a sign deciding process. FIG. 23A is a graph showing a change in a spectrum of a coefficient I(m) to a frequency, wherein a frequency is shown on the abscissa axis and the value of a spectrum is shown on the ordinate axis. Here, it is assumed that coefficients I(1)-I(10) are inputted into the interpolation processor 1 and an interpolation process is performed for I(2)-I(8). The coefficients I(1)-I(10) are inputted into the absolute value computing circuit 17. FIG. 23B is a graph showing a change in an absolute value to a frequency after an absolute value computing process, wherein a frequency is shown on the abscissa axis and the absolute value of a spectrum is shown on the ordinate axis.

Figure 23C:
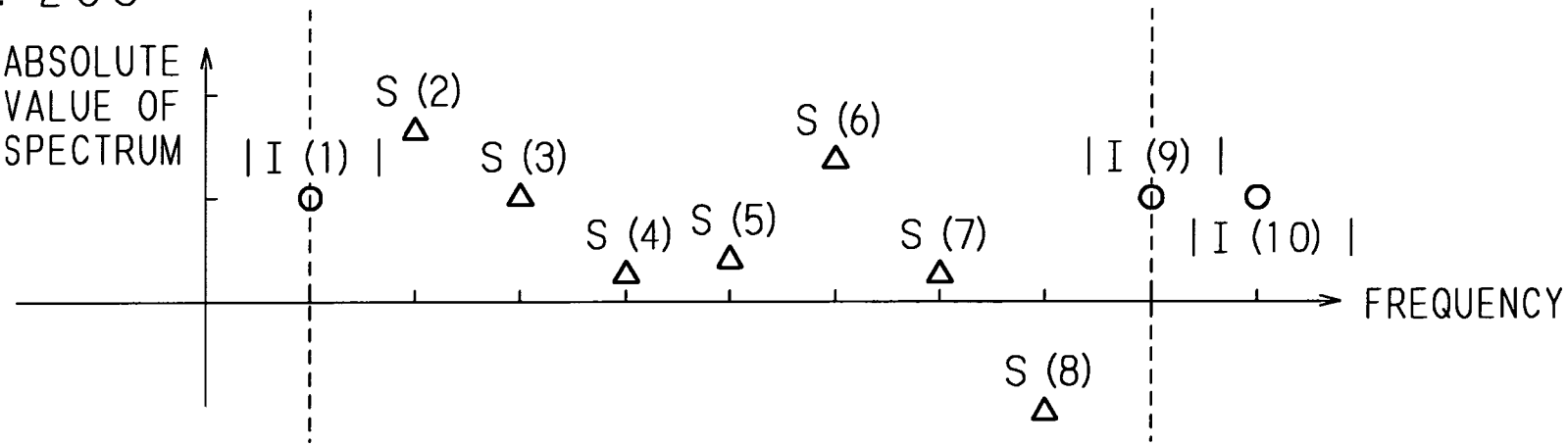

As shown in FIG. 23B, an absolute value process is performed for coefficients having a negative sign, such as I(5) and I(6), and |I(1)|-|I(10)| are obtained. FIG. 23C is a graph showing a change in an absolute value to a frequency after an interpolation process by the computing circuit 14, wherein a frequency is shown on the abscissa axis and the absolute value of a spectrum is shown on the ordinate axis. An interpolation process is performed for a section of |I(2)|-|I(8)| and interpolation coefficients S(2)-S(8) are obtained. Here, since interpolation is performed based on a coefficient according to an absolute value, an interpolation coefficient having a positive sign is originally obtained. Here, when focusing on the interpolation coefficient S(8), a negative value is computed. The modifying circuit 18 gives a value of 0 to the interpolation coefficient S(8) and outputs I'(8) to the adding circuit 19.

Figure 23D:
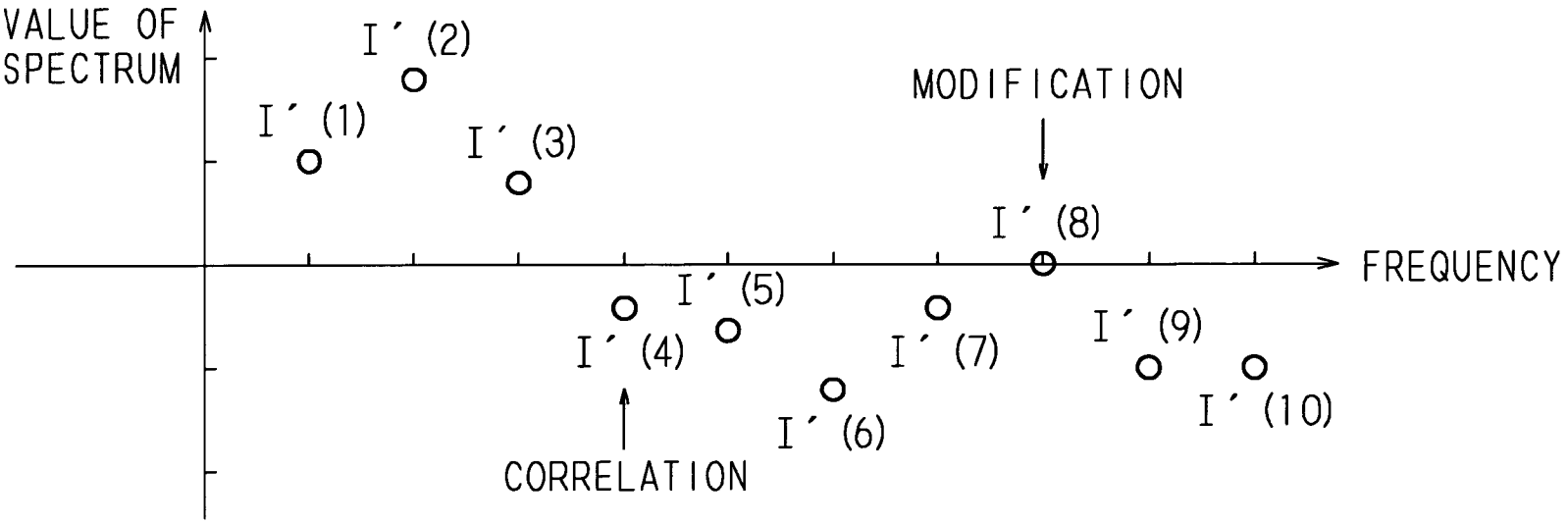

FIG. 23D is a graph showing a change in a spectrum to a frequency after a sign adding process is performed, wherein a frequency is shown on the abscissa axis and the value of a spectrum is shown on the ordinate axis. The spectrum of the modified coefficient I'(8) is set to 0 as shown in FIG. 23D. The adding circuit 19 adds the sign of the absolute values |I(1)|, |I(9)| and |I(10)| of coefficients to which an interpolation process is not performed. The sign extracting circuit 123 extracts the sign of the coefficients I(1), I(9) and I(10) before the absolute value process is performed. The sign extracting circuit 123 extracts the sign of positive (corresponding to I(1)), negative (corresponding to I(9)) and negative (corresponding to I(10)), respectively (see FIG. 23A). The signs of the coefficients are then outputted to the adding circuit 19. The adding circuit 19 adds the signs of positive, negative and negative respectively to the absolute values |I(1)|, |I(9)| and |I(10)| of coefficients and obtains I'(1) (positive value), I'(9) (negative value) and I'(10) (negative value).

Next, the adding circuit 19 adds a sign for the interpolation coefficients S(2)-S(7). The sign extracting circuit 123 extracts the signs of the coefficients I(2)-I(7) (positive, positive, no sign, negative, negative, negative; see FIG. 23A) and outputs the same to the adding circuit 19. The adding circuit 19 adds the signs of the coefficients I(2)-I(7) respectively to the interpolation coefficients S(2)-S(7) and obtains I'(2) (positive), I'(3) (positive), I'(5) (negative), I'(6) (negative) and I'(7) (negative) (see FIG. 23D).

At last, the adding circuit 19 adds the sign of the interpolation coefficient S(4). Since the sign of the coefficient I(4) does not exist, the correlation degree computing circuit 122 reads out contiguous coefficients I(2), I(3), I(5) and I(6), refers to the coefficient storage 121 and reads out a plurality of (four in the present example) MDCT coefficients. The correlation degree computing circuit 122 then computes the correlation value, sequentially changes an MDCT coefficient to be read out and decides the sign of an MDCT coefficient at the center of MDCT coefficients having the highest correlation value as the sign of the coefficient I(4). Here, it is assumed that a negative sign is obtained. After extracting a negative sign, the sign extracting circuit 123 outputs said sign to the adding circuit 19, and the adding circuit 19 obtains I'(4) to which a negative sign is added. The adding circuit 19 outputs coefficients I'(1)-I'(10) obtained as described above to the frequency-time transforming circuit 24.

Figure 24A:
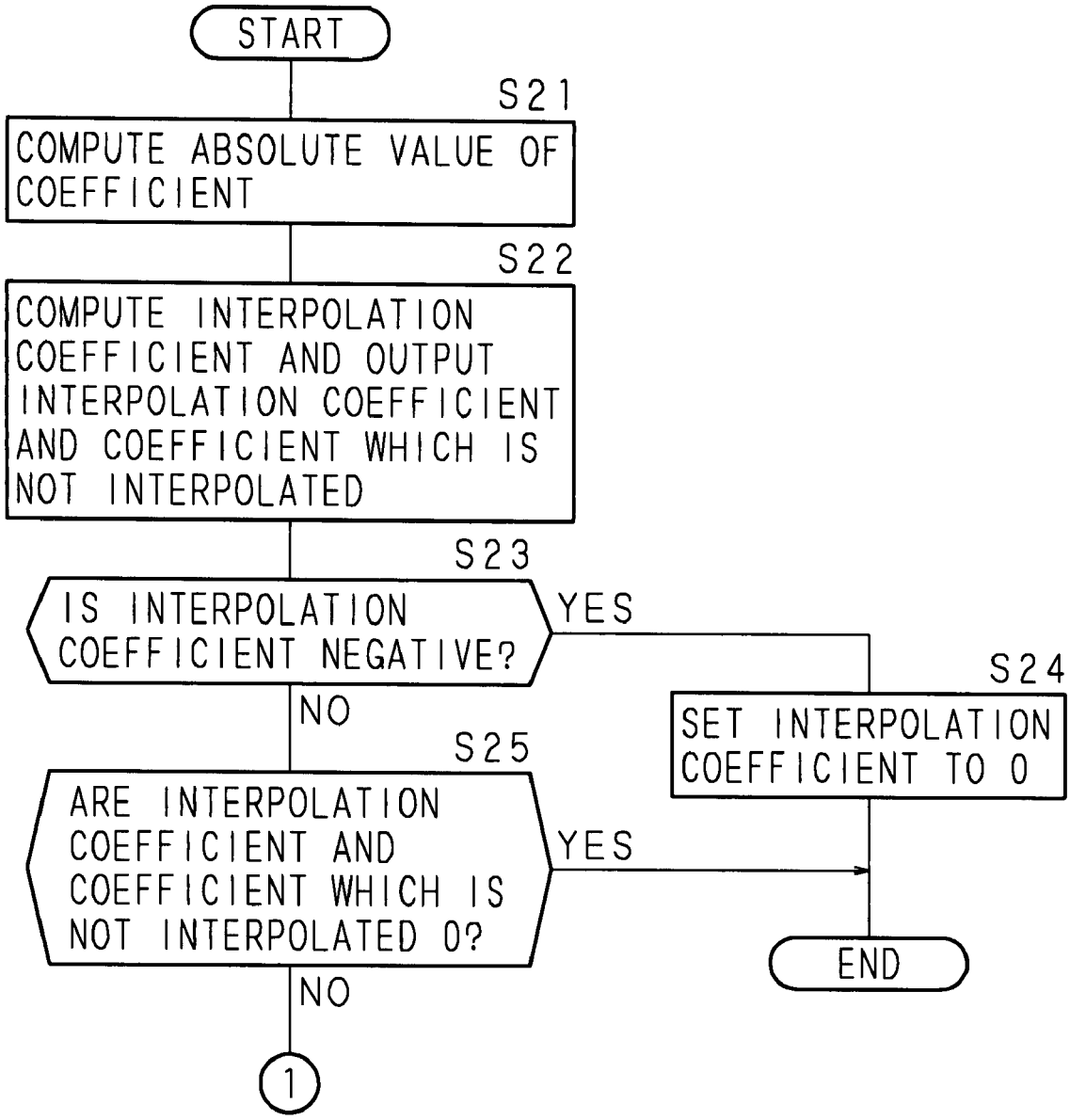
FIGS. 24A and 24B are a flow chart showing the procedure of a sign deciding process.
Figure 24B:
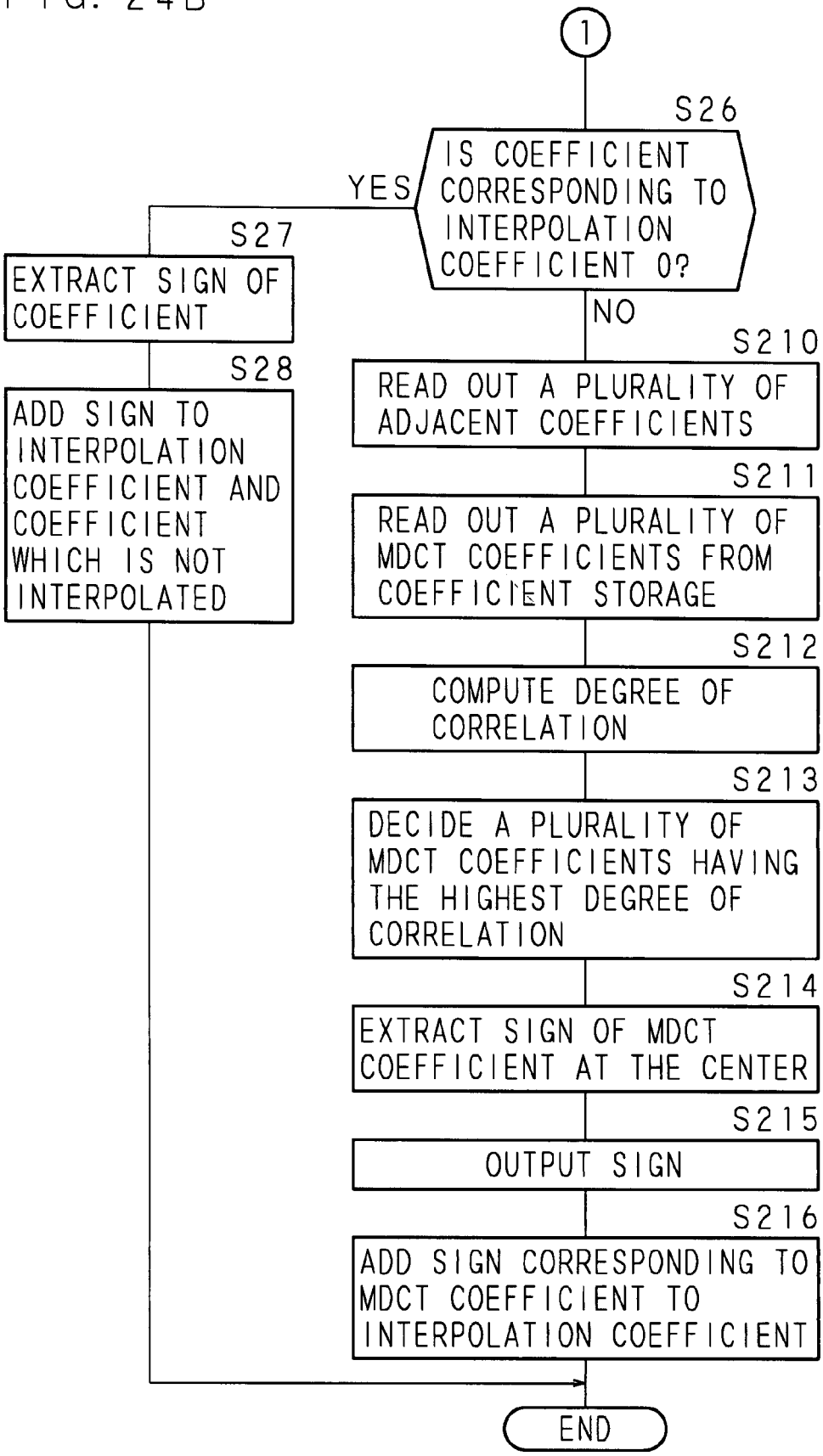

FIGS. 24A and 24B are a flow chart showing the procedure of a sign deciding process. First, the absolute value computing circuit 17 computes the absolute value of a coefficient (step S21). An interpolation coefficient is computed by the process of the selecting circuit 13 and the computing circuit 14, and the interpolation coefficient and a coefficient which is not interpolated are outputted to the modifying circuit 18 (step S22). The modifying circuit 18 determines whether the interpolation coefficient is negative or not (step S23). When determining that the interpolation coefficient is negative (YES in the step S23), the modifying circuit 18 modifies said interpolation coefficient to 0 (step S24).

On the other hand, when determining that the interpolation coefficient is not negative (NO in the step S23), the adding circuit 19 determines whether the interpolation coefficient and the coefficient which is not interpolated are 0 or not (step S25). When determining that the interpolation coefficient and the coefficient which is not interpolated are 0 (YES in the step S25), the adding circuit 19 determines that it is unnecessary to add a sign and terminates the process for said interpolation coefficient and the coefficient which is not interpolated. On the other hand, when determining that the interpolation coefficient and the coefficient which is not interpolated are not 0 (NO in the step S25), the adding circuit 19 determines whether a coefficient corresponding to an interpolation coefficient is 0 or not (step S26).

When the adding circuit 19 determines that the coefficient corresponding to the interpolation coefficient is not 0 (NO in the step S26), the sign extracting circuit 123 extracts the sign of the coefficient (step S27) and adds the extracted sign to the interpolation coefficient and the coefficient which is not interpolated (step S28). When the adding circuit 19 determines in the step S26 that the coefficient corresponding to the interpolation coefficient is 0 (YES in the step S26), the sign extracting circuit 123 reads out a plurality of coefficients adjacent to said coefficient (step S210). The correlation degree computing circuit 122 reads out a plurality of MDCT coefficients from the coefficient storage 121 (step S211).

The correlation degree computing circuit 122 computes a degree of correlation between the plurality of read-out adjacent coefficients and a plurality of MDCT coefficients (step S212). The correlation degree computing circuit 122 refers to the coefficient storage 121, changes the MDCT coefficient as needed and decides a plurality of MDCT coefficients having the highest degree of correlation (step S213). The sign extracting circuit 123 causes the correlation degree computing circuit 122 to refer to the coefficient storage 121 and extracts the sign of an MDCT coefficient at the center of a plurality of decided MDCT coefficients (step S214). The sign extracting circuit 123 outputs the extracted sign to the adding circuit 19 (step S215). The adding circuit 19 then adds a sign corresponding to the MDCT coefficient to the interpolation coefficient (step S216). It should be noted that, though the sign of an interpolation coefficient is obtained in the present embodiment by computing a degree of correlation between adjacent interpolated coefficients and a plurality of MDCT coefficients read out from the coefficient storage, the sign can be obtained by preliminarily classifying MDCT coefficients in the coefficient storage into approximately 8 levels and putting an MDCT coefficient into any one of eight classes having high correlation based on the slope of an envelope of contiguous coefficients. Furthermore, as a more simple method, putting an MDCT coefficient into any one of some classes having high correlation based only on the signs of the adjacent coefficients can partly substitute the above technique.

Since the present Embodiment 8 has such a structure and other structures and functions are the same as those of Embodiments 1 to 7, like codes are used to refer to like parts and detailed explanation thereof will be omitted. It should be noted that, though the present example is explained using an example wherein an MDCT is used as the orthogonal transform method, the present invention is not limited to this and an orthogonal transform having a sign, such as DCT, can be applied.

Embodiment 9

Figure 25:
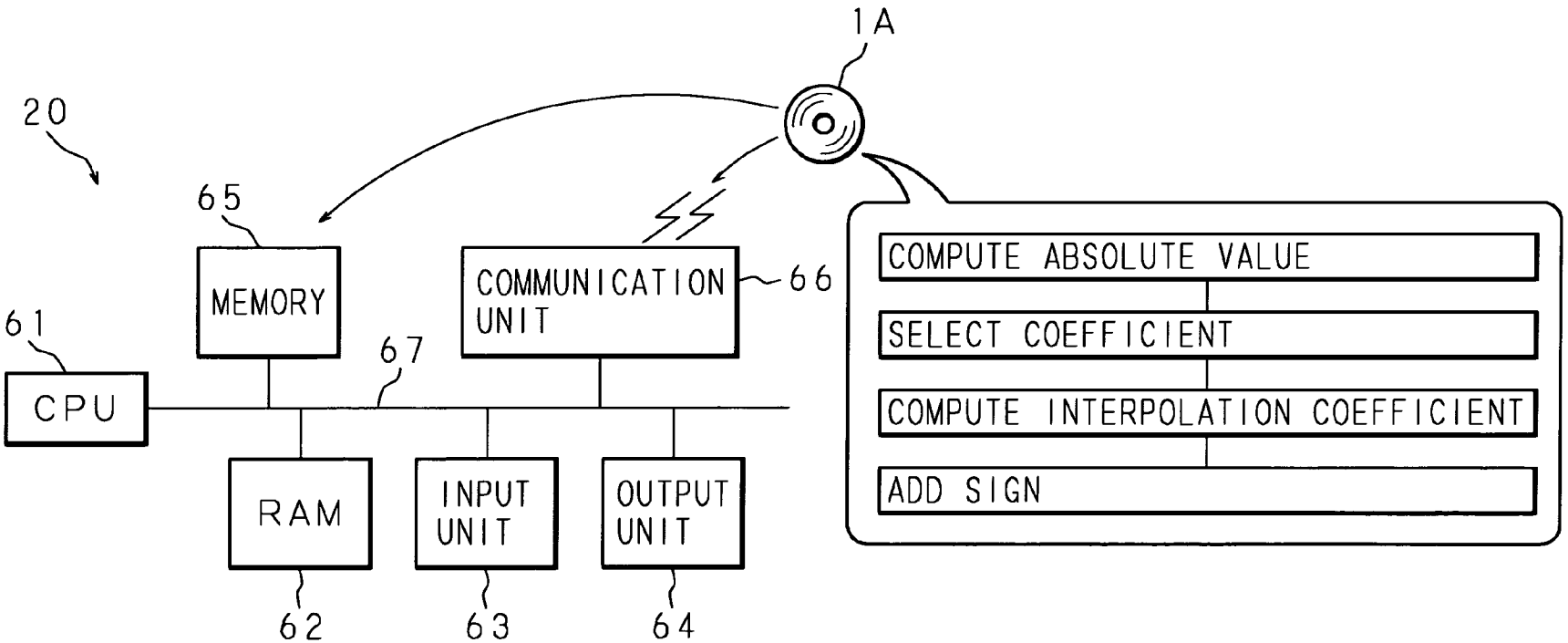
FIG. 25 is a block diagram showing the structure of a signal processing apparatus according to Embodiment 9.

The process according to Embodiment 8 may be realized as a software process using a personal computer shown in FIG. 11. FIG. 25 is a block diagram showing the structure of a signal processing apparatus 20 according to Embodiment 9. A computer program for causing the personal computer 20, which is a signal processing apparatus, to operate can be provided in the form of a portable recording medium 1A such as a CD-ROM, an MO or a DVD-ROM as in the present Embodiment 9. Furthermore, it is also possible to download the computer program from a server computer, which is not illustrated, via the communication unit 66. The following description will explain the content thereof.

The portable recording medium 1A (CD-ROM, MO, DVD-ROM or the like), which records therein a computer program for causing a reader/writer, that is not illustrated, in the personal computer 20 shown in FIG. 25 to compute an absolute value, select a coefficient, compute an interpolation coefficient and add sign, is inserted to install said program into a control program in the memory 65. Instead, such a program may be downloaded from an external server computer, which is not illustrated, via the communication unit 66 and installed into the memory 65. Such a program is loaded into the RAM 62 for execution. In this manner, the personal computer functions as a signal processing apparatus 20 according to the present invention as described above.

Since the present Embodiment 9 has such a structure and other structures and functions are the same as those of Embodiments 1 to 8, like codes are used to refer to like parts and detailed explanation thereof will be omitted.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A signal processing method for performing processing of an acoustic signal obtained by dequantizing a coded acoustic signal, comprising steps of:

receiving coded acoustic signals;

acquiring coefficients by dequantizing the received coded signals; detecting quantization bit rates of the acquired coefficients, respectively, at quantization time of the acquired coefficients;

deciding whether each of the detected quantization bit rates is more than a predetermined value or not;

outputting the coefficients whose detected quantization bit rates are respectively decided to be more than the predetermined value;

picking up the coefficients whose detected quantization bit rates are respectively decided to be not more than the predetermined value;

selecting a plurality of coefficients from the coefficients whose detected quantization bit rates are respectively decided to be more than the predetermined value;

computing an interpolation coefficient for the picked up coefficients using the selected plurality of coefficients;

interpolating the picked up coefficients by utilizing the computed interpolation coefficients to obtain corrected interpolation coefficients;

transmitting the corrected interpolated coefficients; and carrying out the processing on the output coefficients and the transmitted corrected interpolation coefficients.

2. A signal processing apparatus for performing processing an acoustic signal obtained by dequantizing a coded acoustic signal, comprising:

an unpacking circuit receiving coded acoustic signals;

a dequantizing circuit acquiring coefficients by dequantizing the received coded signals;

a quantization bit rate detecting circuit detecting quantization bit rates of the acquired coefficients, respectively, at quantization time of the acquired coefficients;

an interpolation judging circuit deciding whether each of the detected quantization bit rates is more than a predetermined value or not;

the interpolation judging circuit outputting the coefficients whose detected quantization bit rates are respectively decided to be more than the predetermined value;

the interpolation judging circuit picking up the coefficients whose detected quantization bit rates are respectively decided to be not more than the predetermined value;

a selecting circuit for selecting a plurality of coefficients from the coefficients whose detected quantization bit rates are respectively decided to be more than the predetermined value;

a computing circuit for computing an interpolation coefficient for the picked up coefficients using the selected plurality of coefficients;

the computing circuit interpolating the picked up coefficients by utilizing the computed interpolation coefficients to obtain corrected interpolation coefficients;

the computing circuit transmitting the corrected interpolated coefficients; and a transforming circuit carrying out processing on the output coefficients and the transmitted corrected interpolation coefficients.

3. The signal processing apparatus according to claim 2, wherein the selecting circuit is constructed to select a plurality of coefficients according to a quantization bit rate equal to or larger than the predetermined value detected by the detecting circuit from coefficients of a frequency band of a dequantized acoustic signal.

4. The signal processing apparatus according to claim 2, further comprising:

an effective range deciding circuit for deciding an effective range, where a coefficient may exist, to be decided based on a quantization bit rate and a value relating to a scale factor of a coefficient of a frequency band; and a correcting circuit for correcting an interpolation coefficient computed by the computing circuit when the interpolation coefficient does not exist in the effective range decided by the effective range deciding circuit.

5. The signal processing apparatus according to claim 2, wherein the interpolation method in the computing circuit is a Lagrange's interpolation method or a spline interpolation method.

6. The signal processing apparatus according to claim 2, wherein the selecting circuit is constructed to select at least coefficients at both ends from coefficients of each frequency band of a dequantized acoustic signal.

7. The signal processing apparatus according to claim 2, wherein the selecting circuit is constructed to select coefficients at both ends, a coefficient having a maximum value and a coefficient having a minimum value from coefficients of each frequency band of a dequantized acoustic signal.

8. A non-transitory computer-readable recording medium which records therein a program for causing a computer to process an acoustic signal obtained by dequantizing a coded acoustic signal, comprising:

receiving coded acoustic signals;

acquiring coefficients by dequantizing the received coded signals;

detecting quantization bit rates of the acquired coefficients, respectively, at quantization time of the acquired coefficients;

deciding whether each of the detected quantization bit rates is more than a predetermined value or not;

outputting the coefficients whose detected quantization bit rates are respectively decided to be more than the predetermined value, picking up the coefficients whose detected quantization bit rates are respectively decided to be not more than the predetermined value;

selecting a plurality of coefficients from the coefficients whose detected quantization bit rates are respectively decided to be more than the predetermined value;

computing an interpolation coefficient for the picked up coefficients using the selected plurality of coefficients;

interpolating the picked up coefficients by utilizing the computed interpolation coefficients to obtain corrected interpolation coefficients;

transmitting the corrected interpolated coefficients; and carrying out the processing on the output coefficients and the transmitted corrected interpolation coefficients.

* * * * *